US006523489B2

(12) United States Patent
Simard et al.

(10) Patent No.: US 6,523,489 B2
(45) Date of Patent: Feb. 25, 2003

(54) PERSONAL WATERCRAFT AND OFF-POWER STEERING SYSTEM FOR A PERSONAL WATERCRAFT

(75) Inventors: Richard Simard, Drummond (CA); Rénald Plante, Rock-Forest (CA)

(73) Assignee: Bombardier Inc., Valcourt (CA)

( * ) Notice: Subject to any disclaimer, the term of this patent is extended or adjusted under 35 U.S.C. 154(b) by 0 days.

(21) Appl. No.: 09/850,173

(22) Filed: May 8, 2001

(65) Prior Publication Data

US 2001/0027739 A1 Oct. 11, 2001

Related U.S. Application Data

(63) Continuation-in-part of application No. 09/775,806, filed on Feb. 5, 2001, now abandoned.
(60) Provisional application No. 60/180,223, filed on Feb. 4, 2000.

(51) Int. Cl.[7] ..... B63B 35/73
(52) U.S. Cl. ..... 114/55.52; 440/38; 440/43; 114/163; 114/164
(58) Field of Search ..... 440/38, 39, 40, 440/43; 114/162, 163, 164, 55.52

(56) References Cited

U.S. PATENT DOCUMENTS

| | | | |
|---|---|---|---|
| 3,159,134 | A | 12/1964 | Winnen |
| 3,250,072 | A | 5/1966 | Smith |
| 3,272,171 | A | 9/1966 | Korcak |
| 3,280,786 | A | 10/1966 | Rowell |
| 3,326,168 | A | 6/1967 | Swiggart, III et al. |
| 3,327,671 | A | 6/1967 | Comins |
| 3,435,795 | A | 4/1969 | Eckfield |
| 3,565,030 | A | 2/1971 | Curtis |
| 3,628,486 | A | 12/1971 | Bennett |
| 3,780,683 | A | 12/1973 | Doerffer et al. |
| 3,831,543 | A | 8/1974 | Hamasaki |
| 3,842,787 | A | 10/1974 | Giacosa |
| 3,906,885 | A | 9/1975 | Woodfill |
| 3,942,461 | A | 3/1976 | Smith |
| 3,943,876 | A | 3/1976 | Kiekhaefer |
| 3,948,206 | A | 4/1976 | Tyler |
| 3,949,700 | A | 4/1976 | Baroody |
| 3,976,026 | A | 8/1976 | Eastling |
| 3,982,493 | A | 9/1976 | Cronin |
| 3,982,494 | A | 9/1976 | Posti |
| 4,015,556 | A | 4/1977 | Bordiga |
| 4,046,097 | A | 9/1977 | Hornung |
| 4,073,258 | A | 2/1978 | Logan |
| 4,149,469 | A | 4/1979 | Bigler |

(List continued on next page.)

FOREIGN PATENT DOCUMENTS

| | | |
|---|---|---|
| CA | 2207938 | 7/1998 |
| CA | 2270679 | 12/1999 |
| CA | 2271332 | 2/2000 |
| JP | 2000302099 | 10/2000 |

OTHER PUBLICATIONS

Smith, Steve, *Hot Water*, vol. 5, No. 4, "Them's the Brakes," pp. 8, 51.

*Primary Examiner*—Jesus D. Sotelo
(74) *Attorney, Agent, or Firm*—Pillsbury Winthrop LLP

(57) ABSTRACT

A watercraft is disclosed that includes a hull having port and starboard sides and a propulsion system that generates a stream of pressurized water through a nozzle. A helm operatively connects to the nozzle, whereby turning the helm turns the nozzle. At least one rudder connects to either or both of the port or starboard sides. The rudder is capable of pivoting inwardly and outwardly and can also be moved upwardly and downwardly with respect to the side to which it is connected. The rudder is located a certain distance from the respective side of the hull, which allows the rudder to utilize its inner and outer surfaces to assist in steering the watercraft by deflecting water flowing thereacross. Also, a linking element can connect the nozzle to the rudder. An off-power steering system is also disclosed.

155 Claims, 24 Drawing Sheets

U.S. PATENT DOCUMENTS 4,175,721 A 11/1979 Lempa, Jr.
4,232,626 A 11/1980 Kern
4,323,027 A 4/1982 Schermerhorn
4,352,666 A 10/1982 McGowan
4,355,985 A 10/1982 Borst et al.
4,463,700 A 8/1984 Becker
4,583,030 A 4/1986 Nixon
4,615,290 A 10/1986 Hall
4,632,049 A 12/1986 Hall et al.
4,653,418 A * 3/1987 Mori et al. ..... 114/162
4,749,926 A 6/1988 Ontolchik
4,759,732 A 7/1988 Atsumi
4,762,079 A 8/1988 Takeuchi et al.
4,776,205 A 10/1988 Brooks et al.
4,776,295 A 10/1988 Kline et al.
4,779,553 A 10/1988 Wildhaber, Sr.
4,787,867 A 11/1988 Takeuchi et al.
4,854,259 A 8/1989 Cluett
4,908,766 A 3/1990 Takeuchi
4,949,662 A 8/1990 Kobayashi
4,961,396 A 10/1990 Sasagawa
4,964,821 A 10/1990 Tafoya
4,967,682 A 11/1990 O'Donnell
5,062,815 A 11/1991 Kobayashi
5,070,803 A 12/1991 Smith
5,085,603 A 2/1992 Haluzak
5,092,260 A 3/1992 Mardikian
5,094,182 A 3/1992 Simner
5,113,777 A 5/1992 Kobayashi
5,154,650 A 10/1992 Nakase
5,167,547 A 12/1992 Kobayashi et al.
5,193,478 A 3/1993 Mardikian
5,199,193 A 4/1993 Toyohara et al.
5,246,392 A 9/1993 Johnston
5,254,023 A 10/1993 Kobayashi
5,263,432 A 11/1993 Davis
5,310,369 A 5/1994 Kobayashi
5,350,325 A 9/1994 Nanami
5,375,551 A 12/1994 Lunter et al.
5,377,610 A 1/1995 Goebel
5,421,753 A 6/1995 Roos
5,474,007 A 12/1995 Kobayashi
5,494,464 A 2/1996 Kobayashi et al.
5,520,133 A 5/1996 Wiegert
5,607,332 A 3/1997 Kobayashi et al.
5,611,295 A 3/1997 Stables
5,718,611 A 2/1998 Schlangen et al.
5,755,601 A 5/1998 Jones
5,813,357 A 9/1998 Watson
6,032,605 A 3/2000 Takashima
6,068,437 A 7/2000 Murray

* cited by examiner

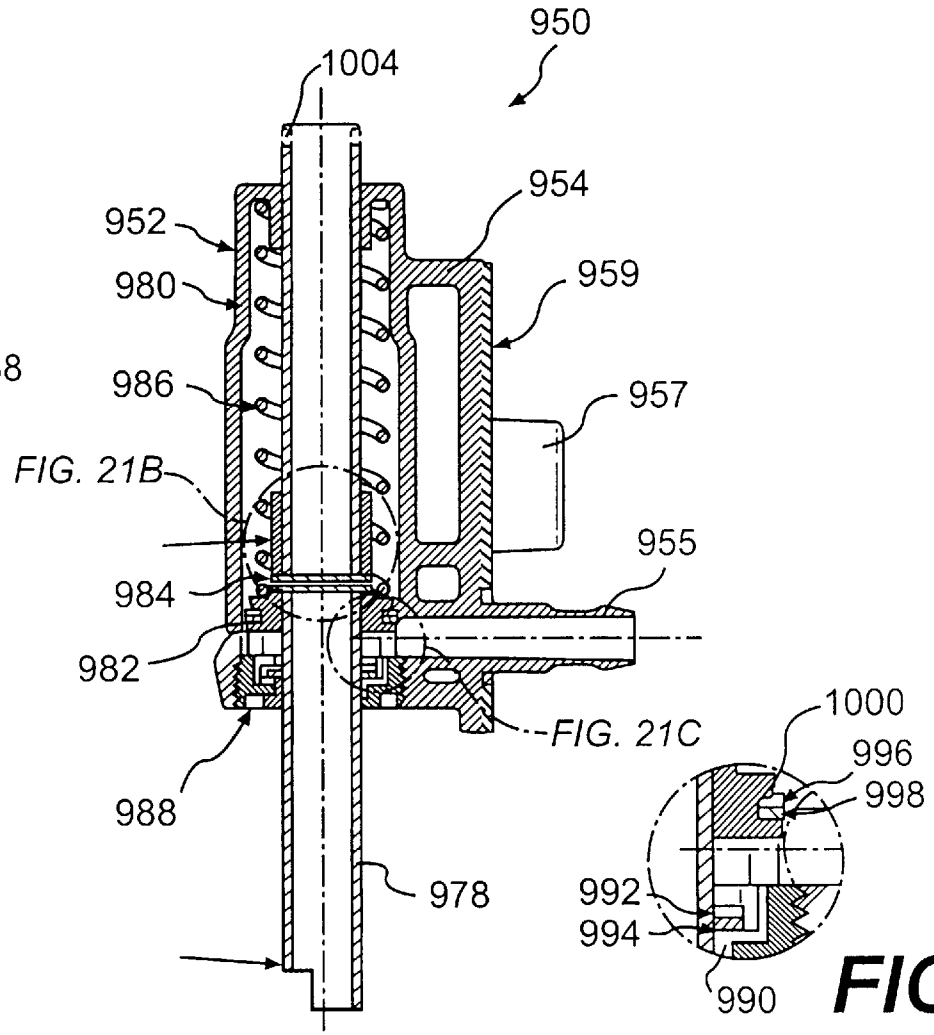
FIG. 21A
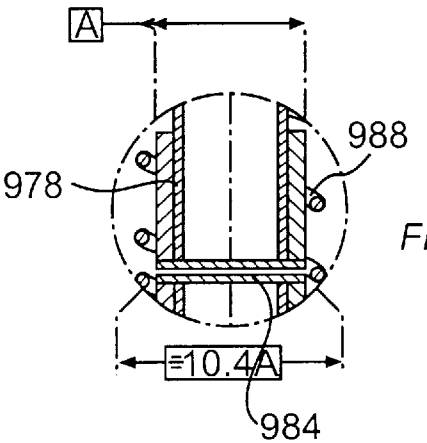
FIG. 21B
FIG. 21C

PERSONAL WATERCRAFT AND OFF-POWER STEERING SYSTEM FOR A PERSONAL WATERCRAFT

The present application is a continuation in part of Simard U.S. application Ser. No. 09/775,806, filed Feb. 5, 2001, now abandoned, and Simard U.S. Provisional Appln. Ser. No. 60/180,223, filed Feb. 4, 2000, the entirety of each of which are hereby incorporated into the present application by reference.

1. Field of the Invention

The present invention relates generally to a steering control mechanism for a personal watercraft ("PWC"). More specifically, the invention concerns a control system that assists in steering a PWC when the jet pump pressure falls below a predetermined threshold.

2. Description of Related Art

Typically, PWCs are propelled by a jet propulsion system that directs a flow of water through a nozzle (or venturi) at the rear of the craft. The nozzle is mounted on the rear of the craft and pivots such that the flow of water may be directed between the port and starboard sides within a predetermined range of motion. The direction of the nozzle is controlled from the helm of the PWC, which is controlled by the PWC user. For example, when the user chooses to make a starboard-side turn, he turns the helm to clockwise. This causes the nozzle to be directed to the starboard side of the PWC so that the flow of water will effect a starboard turn. In the conventional PWC, the flow of water from the nozzle is primarily used to turn the watercraft.

When the user stops applying the throttle, the motor speed (measured in revolutions per minute or RPMs) drops, slowing or stopping the flow of water through the nozzle at the rear of the watercraft and, therefore, reducing the water pressure in the nozzle. This is known as an "off-throttle" situation. Pump pressure will also be reduced if the user stops the engine by pulling the safety lanyard or pressing the engine kill switch. The same thing would occur in cases of engine failure (i.e., no fuel, ignition problems, etc.) and jet pump failure (i.e., rotor or intake jam, cavitation, etc.). These are known as "off-power" situations. For simplicity, throughout this application, the term "off-power" will also include "off-throttle" situations, since both situations have a similar effect on pump pressure.

Since the jet flow of water causes the vehicle to turn, when the flow is slowed or stopped, steering becomes less effective. As a result, a need has developed to improve the steerability of PWCs under circumstances where the pump pressure has decreased below a predetermined threshold.

One example of a prior art system is shown in U.S. Pat. No. 3,159,134 to Winnen, which provides a system where vertical flaps are positioned at the rear of the watercraft on either side of the hull. In this system, when travelling at slow speeds, where the jet flow through the propulsion system provides minimal steering for the watercraft, the side flaps pivot with a flap bar into the water flow to improve steering control.

A system similar to Winnen is schematically represented by FIG. 25, which shows a watercraft 1100 having a helm 1114. Flaps 1116*a,* 1116*b* are attached to the sides of the hull via flap bar 1128*a,* 1128*b* at a front edge. Two telescoping linking elements 1150*a,* 1150*b* are attached to arms 1151*a* and 1151*b,* respectively, at one end and to the respective flap bars 1128*a,* 1128*b* at the other end, respectively. Arms 1151*a,* 1151*b,* are attached to partially toothed gears 1152*a,* 1152*b,* respectively. Gear 1160 is positioned between gears 1152*a,* and 1152*b* to engage them. Gear 1160 is itself operated, through linking element 1165 and steering vane 1170, by helm 1114. FIG. 25 illustrates the operation of the flaps when the watercraft is turning to the right, or starboard, direction.

Because the gears 1152*a,* 1152*b* are only partially toothed, when attempting a starboard turn, only gear 1152*b* will be engaged by gear 1160. Therefore, the left flap 1116*a* does not move but, rather, stays in a parallel position to the outer surface of the hull of the PWC 1100. Thus, in this configuration, the right flap 1116*b* is the only flap in an operating position to assist in the steering of the watercraft 1100.

While the steering system of Winnen, represented in FIG. 25, provides improved steering control, the system suffers from certain deficiencies. First, steering is difficult. When the flap bars 1128 are located at the front portion of the flaps 1116 (as shown), the user must expend considerable effort to force the flaps 1116*a,* 1116*b* out into the flow of water. Second, the force needed to force flaps 1116*a,* 1116*b* into the water stream causes considerable stress to be applied to the internal steering cable system that may cause the cable system to weaken to the point of failure. Third, only one flap 1116*b* is used at any given moment to assist in low speed steering. Thus, the steering system shown in FIG. 25 is difficult to use, applies unacceptable stresses to the internal steering system, and relies on only half of the steering flaps to effectuate a low speed turn.

Such a system could be modified to use simpler telescoping linking elements to attach the steering vane 1170 to flaps 1116, instead of the more complex gear arrangement. Unfortunately, the sliding nature of the telescoping linking elements makes these structures susceptible to seizing up in salt water.

For at least these reasons, a need has developed for an off-power steering system that is more effective in steering a PWC when the pump pressure has fallen below a predetermined threshold.

SUMMARY OF THE INVENTION

A PWC according to this invention has an improved system comprising at least one flap or rudder placed at a side of the hull. This invention relates to the design and operation of generally vertical rudders positioned on the port and starboard sides of the PWC hull that assist in steering the PWC when the pump pressure falls below the predetermined threshold. In addition, the rudders can be vertically adjustable to provide even greater assistance in steering control when the pump pressure falls below the predetermined threshold.

Therefore, one aspect of embodiments of this invention provides an off-power steering system in which the rudders and linking elements assist the driver in steering a PWC in off-power situations without causing undue stress on the driver or the helm control steering mechanisms.

Another aspect of the present invention provides a PWC with simplified linking elements that do not seize up in salt water, and are less complex than those known in the prior art.

An additional aspect of the present invention provides an off-power steering mechanism that automatically raises and lowers vertical rudders according to the water flow pressure within the venturi or flow nozzle.

A further aspect of the present invention can make off-power steering more efficient by using both rudders simultaneously and in tandem to assist in steering.

Embodiments of the present invention also provide an improved rudder that can be used with an off-power steering system.

An additional embodiment of the present invention provides an off-power steering mechanism kit to retrofit a PWC that was not manufactured with such a mechanism.

These and other aspects of the present invention will become apparent to those skilled in the art upon reading the following disclosure. The present invention preferably provides a rudder system wherein a rudder is positioned near the stern and on each side of the hull of a PWC. The preferred embodiment utilizes a pair of vertically movable rudders operating in tandem during steering.

The invention can provide a steering system that is simpler to build and easier to steer. The system can automatically lower the vertical rudders when off-power steering is necessary and can automatically raise the vertical rudders when off-power steering is not needed.

The rudders according to this invention are spaced a predetermined distance from the hull and pivot from a position inwardly from an edge of the rudder to enable water to flow on an inside surface and an outside surface. Other embodiments of the invention are described below.

It is contemplated that a number of equivalent structures may be used to provide the system and functionality described herein. It would be readily apparent to one of ordinary skill in the art to modify this invention, especially in view of other sources of information, to arrive at such equivalent structures.

BRIEF DESCRIPTION OF THE DRAWINGS

An understanding of the various embodiments of the invention may be gained by virtue of the following figures, of which like elements in various figures will have common reference numbers, and wherein:

FIG. 21 is a cross-sectional view taken along line A—A of FIG. 20;

DETAILED DESCRIPTION OF PREFERRED EMBODIMENTS

The invention is described with reference to a PWC for purposes of illustration. However, it is to be understood that the steering and stopping systems described herein can be utilized in any watercraft, particularly those crafts that are powered by a jet propulsion system.

Figure 1:
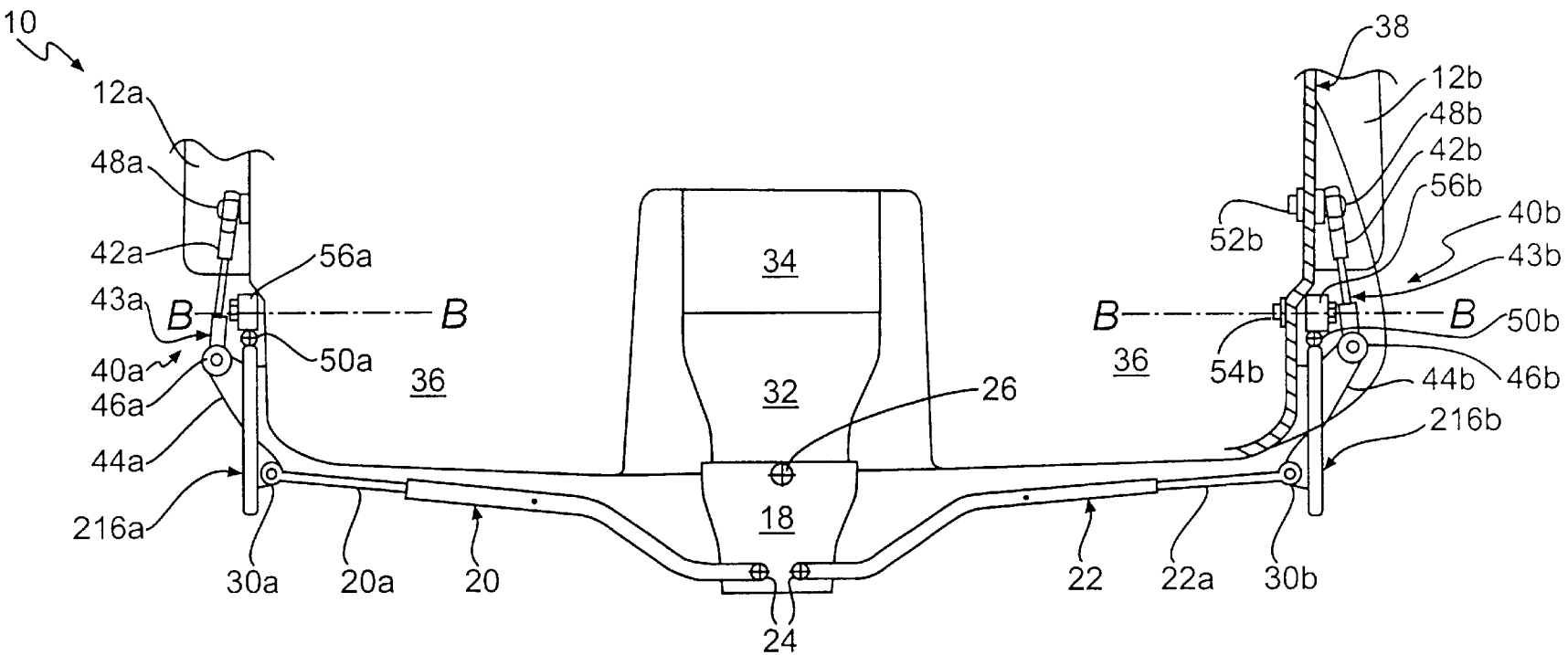
FIG. 1 illustrates a top view in partial section of a first embodiment of the present invention with the flaps in the inactive position.
Figure 2:
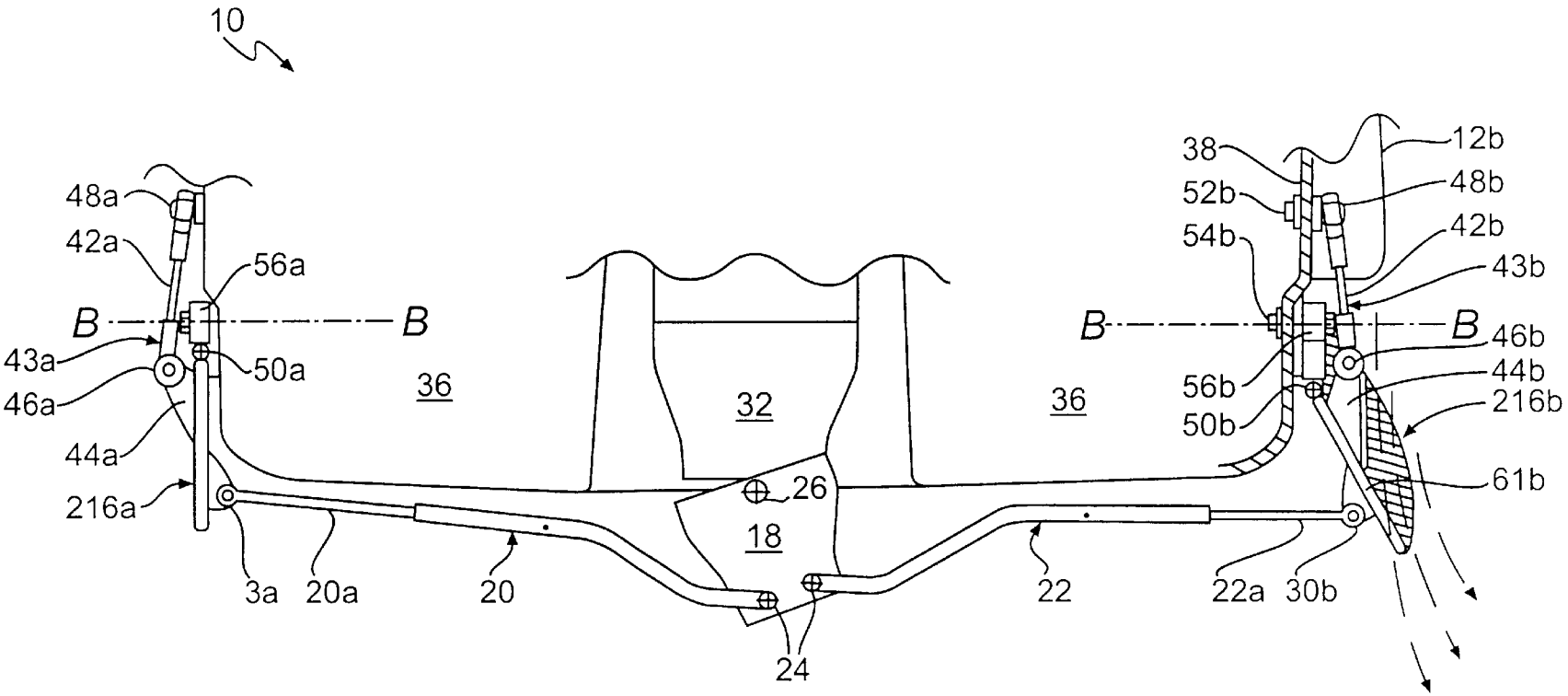
FIG. 2 illustrates the first embodiment of the present invention with the starboard flap in an operable position.
Figure 3:
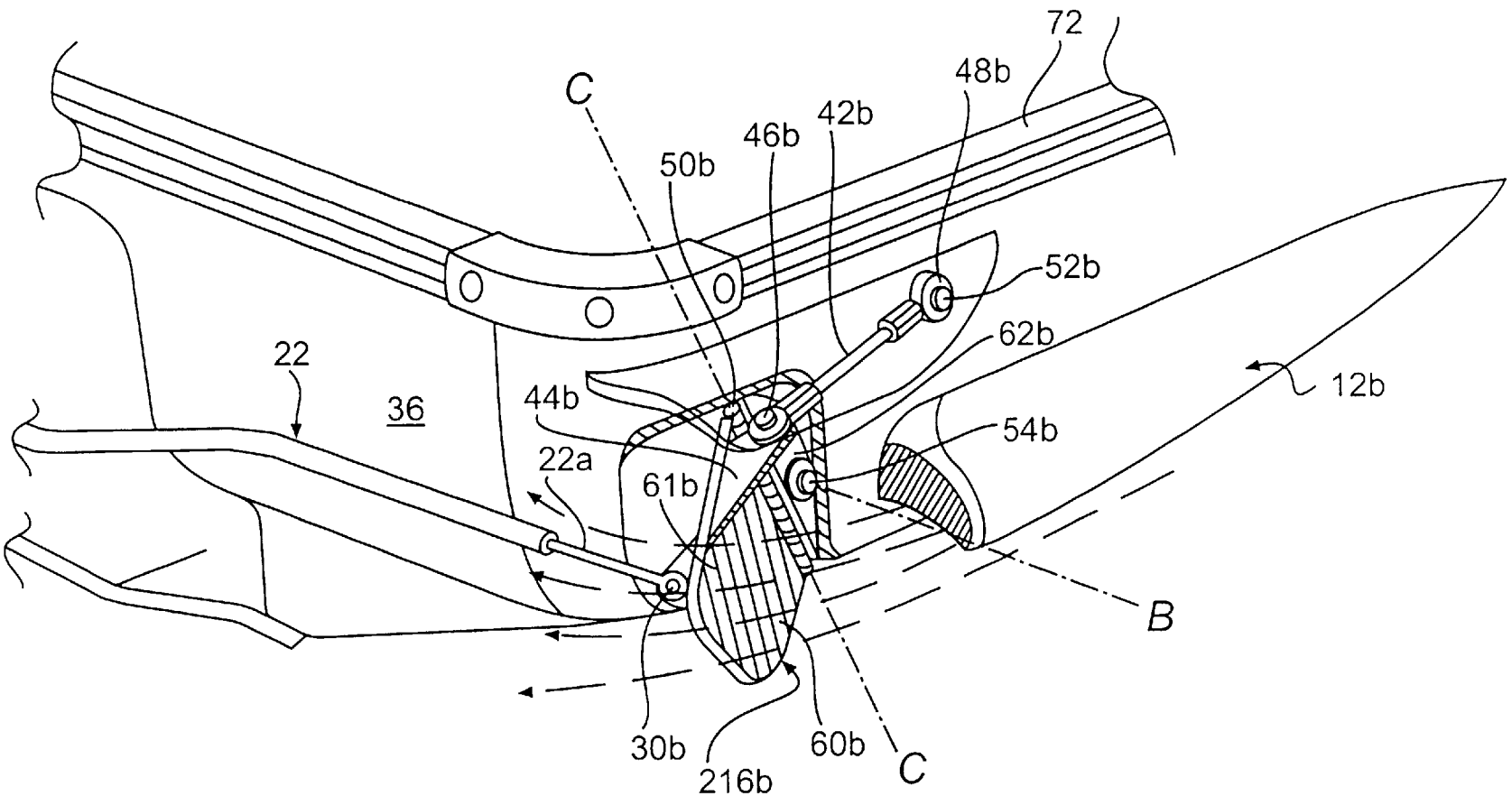
FIG. 3 is a perspective view of the starboard flap in an operable position.

The first embodiment of the invention will be understood with reference to FIGS. 1–3. In FIG. 1, a top view of the stern of the PWC 10 is shown. The hull 38 is only shown generally in a schematic outline to highlight the important structures of the invention. In some of the following figures, a flap or rudder system of only one side of a PWC 10 is shown for simplicity. It is to be understood that the system described for one flap or rudder is equally applicable for a flap or rudder on the other side of the craft.

The first embodiment of the invention is referred to as a "flap" system because the flaps are hinged at an edge and thus only one side of the flap deflects water to assist in steering. The prior art system to Winnen described above is an example of a flap system. The other embodiments discussed below are referred to as "rudder" systems because the rudder pivots at a point spaced a certain distance inward from the edge of the rudder. In addition, the rudders are positioned away from the surface of the hull to enable water to flow on both the inside surface and/or the outside surface of the rudder to assist in steering the PWC. The advantages of the rudder system are described in more detail below.

It is understood that a corresponding flap or rudder system is preferably placed on each side of the hull 38 shown in FIG. 1. Although the preferred two flap or rudder system is shown in the embodiments disclosed herein, a single flap or rudder can be used if desired. It is also preferable to have the flap or rudder system as far as possible from the center of gravity of the PWC (i.e., near the transom) while still being located in the high pressure relative flow generated by travel of the hull through the water in order to have the greatest possible moment arm for the forces applied by the flap or rudder. This will provide more efficient steering. Accordingly, where specific details regarding the off-power steering structure are provided for only one side, the details are applicable to a corresponding structure on the opposite side. Additionally, while the flap or rudder is shown as being attached to a side of the hull, it is also possible to attach a flap or rudder in accordance with this invention to the stem while still projecting from the side.

The flap system according to the first embodiment of the present invention provides a steering system in which the flaps 216*a,* 216*b* each rotate around two different axes instead of just one. The object of this embodiment is to position the flaps deep in the water to increase their steering efficiency while minimizing the contact with the water to minimize drag when the flaps are not required for steering.

The flap systems 40*a,* 40*b* comprise the flaps 216*a,* 216*b* and double-ended ball joints 43*a,* 43*b* that attach the flaps 216*a,* 216*b* to the hull 38. Flap system 40*a* is on the port side, and flap system 40*b* is on the starboard side. The double-ended ball joints 43*a,* 43*b* comprise rods 42*a,* 42*b* connected 48*a,* 48*b* to the hull 38. Any known means may be used to secure the rods 42*a,* 42*b* to the hull 38, such as a nut and bolt 52*a,* 52*b*. The ball joint rods 42*a,* 42*b* are linked by connectors 46*a,* 46*b* to ears 44*a,* 44*b*. The ears 44*a,* 44*b* are connected to flaps 216*a,* 216*b,* respectively, at a top portion thereof.

As shown in FIG. 1, flap 216*b* has a hinged connection 50*b* connected to another hinged connection element 56*b*. The connection 56*b* pivots around the axis shown as B—B. This is the first of two axes around which the flap 216*b* rotates. The second axis of rotation for the flap 216*b* is provided by hinge 50*b*. A front flange, which is shown as 62*b* in FIG. 3 for the starboard side flap system of this hinge 50*b,* is mounted on a pivot 56*b* attached (by a screw for example) into the hull 38. The pivot 56*b* allows the vertical hinge 50*b* to rotate around a horizontal axis.

The flap system 40*a* is connected via connecting element 30*a* to a telescoping linking element 20. The inner structure of the telescoping linking element is referred to as 20*a*. The telescoping structure 20 is connected to a nozzle 18 via a pivoting element 24. The pivoting element 24 can be any structure that enables the linking structures to connect to the nozzle 18 and permits the nozzle 18 to pivot to manipulate the flaps 216*a,* 216*b*. Nozzle 18 revolves around pivotal point 26 to steer the PWC 10 at high speeds (or with the throttle in the on position).

The venturi 32 directs the flow of water from the jet propulsion system 34 and causes the water to increase in speed as it flows through the venturi 32 to the nozzle 18. The diameter of the venturi 32 decreases to force the water to travel faster through the venturi opening. A stabilizer or sponson 12*a,* 12*b* attached to the outer surface of the hull on the port side directs the flow of water and assists in stabilizing the PWC 10. While FIG. 2 illustrates the venturi 32 and nozzle 18 as separate elements pivotally connected, it is noted that variations of the venturi/nozzle structure are considered to be within the scope of the present invention. Thus various water propulsion structures may be used to perform the functions of the venturi/nozzle combination, namely propelling water at a high rate of speed along with providing steering capabilities.

FIG. 3 illustrates the starboard flap 216*b* in an operational position. To move flap 216*b* into this position, the user turns the helm, in this case a handle bar, (not shown) to the right or in the starboard direction. The nozzle 18 pivots around pivoting point 26 to steer the watercraft to the starboard direction. The pivotal connection 24 causes linking element 22 and telescoping insert 22*a* to force the flap 216*b* out into the flow of water (shown by the intermittent arrows). In this position, the flap 216*b* is connected to the hull by element 44*b,* which is attached to rod 42*b* by structure 46*b*. Rod 42*b* is connected to the hull by ball joint 52*b*. It is preferred that the rod 42*b* is stiff, so that it does not allow the connecting element 44*b* to pivot with respect to the rod 42*b*. However, it is contemplated that structures providing flexibility at this point may also be used.

The rod 42*b* connects through connector 48*b* to the hull 38 via bolt and nut arrangement 52*b* or some equivalent structure. The connecting element 44*b,* structure 46*b* and rod 42*b* firmly hold the top portion 61*b* of flap 216*b* in place and prevent it from swinging out vertically into the flow of water. While one particular arrangement is illustrated, other equivalent structures may also be provided to support the top portion 61*b* of the flap 216*b*.

When the helm 14 moves, it causes the flap 216*b* to assist in turning the PWC 10 into the starboard direction. In operation, the flap 216*b* pivots out into the water on hinge 50*b* in a substantially vertical direction and also pivots on bolt 54*b* around the axis shown by line B—B. Similarly, when the flap 216*a* is forced outwardly because of the pushing force coming from the telescopic linking element 20, the double ended ball joint 43*a* and ear 44*a* simultaneously push back the top of the flap 216*a*. By the effect of the force given by the ear 44*a,* the rear of the flap 216*a* is forced to go down deeper into the water.

In this embodiment, because telescoping linking arms 20, 22 are used, the flap 216*a* that is opposite the flap 216*b* being moved into the operative position remains parallel to the side of the hull 38 and the PWC in an inactive position. Thus, only one flap at a time provides steering assistance. These linking arms 20, 22 may be considered an actuator that enables the flaps to be operated by the operator a manipulating the helm (i.e., in the illustrated embodiment, turning the helm to pivot the nozzle, which in turn operates the flaps as described).

FIG. 3 is a perspective view of the flap 216*b* in the operative position. The flap supporting structure 44*b,* 42*b,* 46*b* and 48*b* secures the top portion of the flap 216*b* to prevent it from swinging outwardly or pivoting downwardly into the flow of water. As can be seen from FIG. 3, the lower portion 60*b* of the flap 216*b* pivots out further into the flow of water than the top portion illustrated by feature 61*b*. This causes the water to flow more easily over the top portion 61*b* of flap 216*b,* as illustrated by the intermittent arrows. Thus, in the operative position, flap 216*b* pivots around both the axis of hinge 50*b,* which axis is shown by intermittent line C—C, and the axis of bolt 54*b,* which is connected to hinge 50*b* via a connecting structure shown as 62*b*. The axis of rotation shown by the intermittent line B—B shows flap 216*b* rotated into an optimal position in the water coming from stabilizer 12*b*.

While the first embodiment described above uses flaps in which water will flow on only one side, the dual pivoting motion of the flap about two different axes makes it more efficient and effective than a system having a single pivoting motion, such as Winnen.

Figure 4:
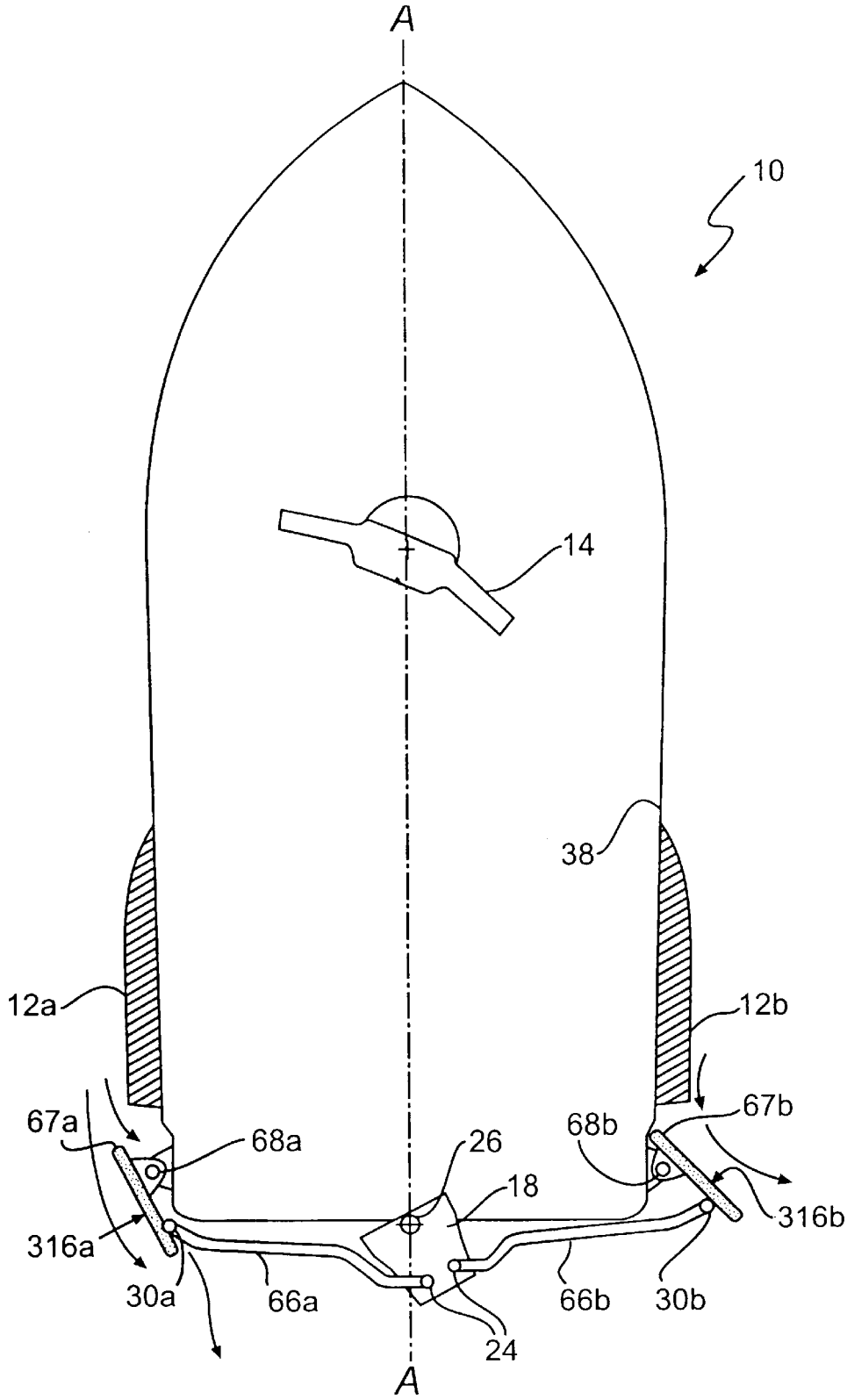
FIG. 4 illustrates a top schematic view of a second embodiment of the present invention.

FIG. 4 illustrates the second embodiment of the present invention. This embodiment is directed to addressing the problems of (1) the lack of efficiency in using only one rudder at a time to steer, and (2) the stresses transferred to the steering components.

According to an embodiment of the invention as shown in FIG. 4, the PWC 10 has a helm 14. Stabilizers or sponsons 12*a*, 12*b* are attached at the side rear of the hull 38 and rudders 316*a*, 316*b* are connected to the hull 38 via hinges 68*a*, 68*b*. The hinges 68*a*, 68*b* connect the rudders 316*a*, 316*b* to the hull 38 a certain distance from the forward ends of the rudders 316*a*, 316*b*.

A nozzle 18 pivots around a pivoting connection 26. This pivoting connection 26 may be of any kind that is well known to those of ordinary skill in the art. The nozzle 18 is pivotally connected 24 to linking elements 66*a*, 66*b*, which may be considered part of an actuator that enables the rudder 316*a*, 316*b* to be operated by operator manipulating the helm. In the preferred embodiment, the linking elements 66*a*, 66*b* are not telescoping but are made from a single rigid structure. In this manner, they are easier to build and are more reliable than more complicated, telescoping structures known in the prior art. By using non-telescoping linking elements 66*a*, 66*b*, both rudders 316*a*, 316*b* are simultaneously moved with the rotation of the nozzle 18.

As shown in FIG. 4, when the PWC 10 is turned to the starboard direction via the helm 14, the nozzle 18 directs water flow from the jet propulsion system toward the starboard side of the PWC 10, which causes it to turn. According to the present invention, when the nozzle 18 is in this position, the port side rudder 316*a* is pulled inward toward the longitudinal axis of the PWC 10, shown by line A—A. Pulling the port side rudder 316*a* inward increases water pressure on the inside surface of rudder 316*a*, which assists in steering PWC 10 in the starboard direction. In addition, linking element 66*b* extends rudder 316*b* out into the water flowing off of sponson 12*b*. Since linking elements 66*a*, 66*b*, are pivotally connected 24 to a different portion of the nozzle 18, rudders 316*a*, 316*b*, have different turning angles. For a starboard turn, rudder 316*b* turns more than rudder 316*a* and creates a larger angle with respect to the axis A—A. Rudder 316*a* creates a high lift and a low drag, while rudder 316*b* creates a high drag and a high lift, both of which assist in steering the PWC to the starboard direction.

In addition, because hinged elements 68*a*, 68*b* are placed inward from the ends 67*a*, 67*b* of the rudders 316*a*, 316*b*, it is easier for the user to turn the steering mechanism at the helm 14 to manipulate the rudders 316*a*, 316*b* into the flow of water to assist in the off-throttle steering. Thus, this system reduces the stress both on the steering mechanisms and on the user.

Figure 5:
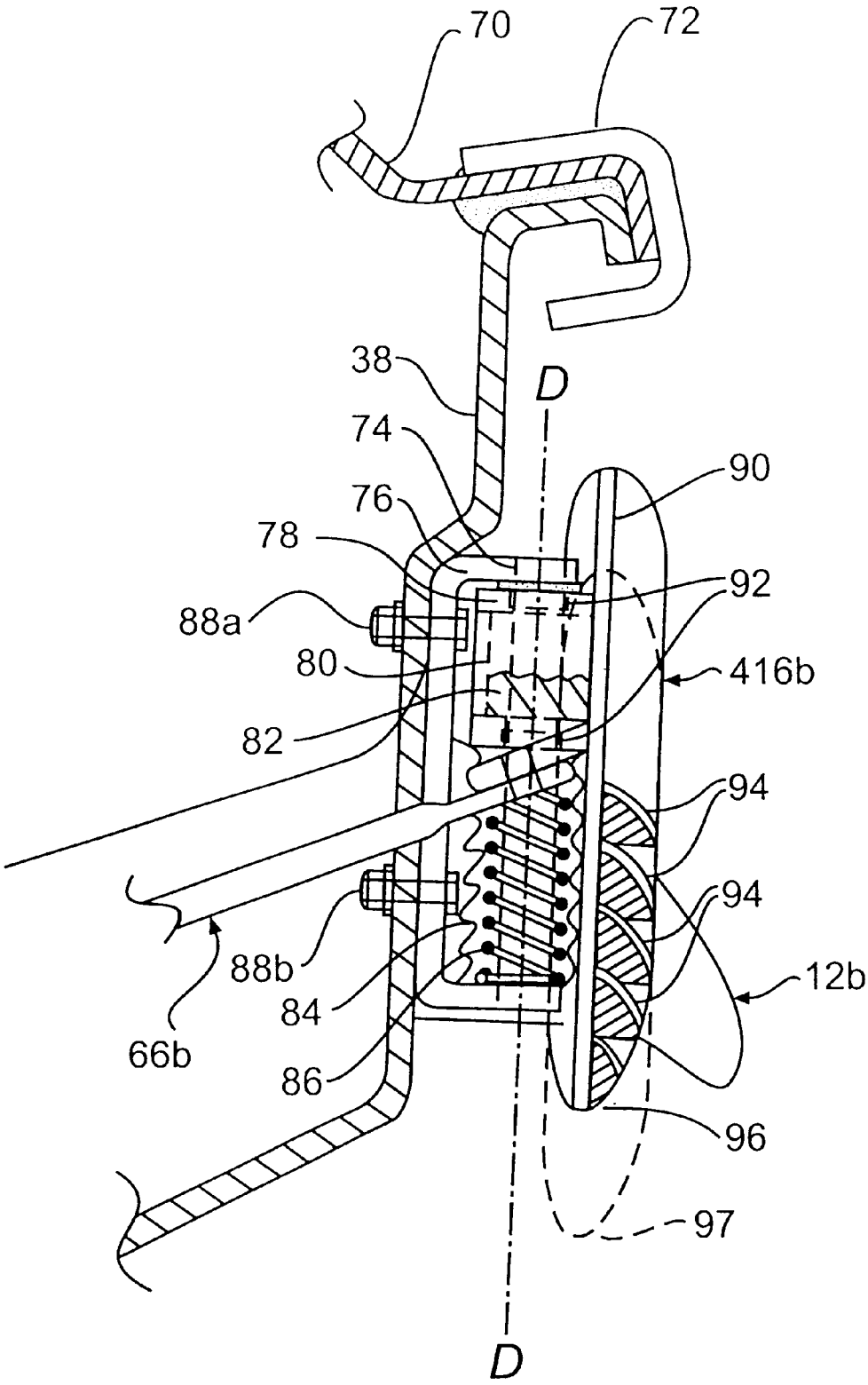
FIG. 5 illustrates a back view in partial section of a third embodiment of the present invention.

Turning to FIG. 5, this figure illustrates the third embodiment of the present invention. This embodiment is directed to addressing some of the same problems as the second embodiment above. In addition, the third embodiment also addresses the problem of the drag on the rudders when they are in the lower position in the water. If the rudders are always in a down position, they tend to produce drag in the water and slow the PWC down when it is operating at high speeds.

As shown in FIG. 5, the hull 38 of the PWC 10 is connected to the deck 70 and a covering structure 72 covers the connecting point between the deck 70 and the hull 38. Bolts 88*a*, 88*b* connect a U-shaped bracket structure 76 to hull 38 to support rudder 416*b* and enable it to move up and down. The bracket 76 also supports the hinged movement of rudder 416*b* around the axis shown as D—D. The starboard linking element 66*b* is shown attached generally to rudder 416*b*. A spring 86 biases the rudder 416*b* into a high inactive position out of the water. The bottom 96 of rudder 416*b* is shown in its high position and, in phantom 97, in the lower position. Bushings 92 allow the rudder 416*b* to move up and down with less friction. Preferably, a lubricant 82 is used for durability. The hinge structure supported by the bracket 76 enables the rudder 416*b* to both move up and down to a position in or out of the water and also to rotate around axis D—D.

Figure 6:
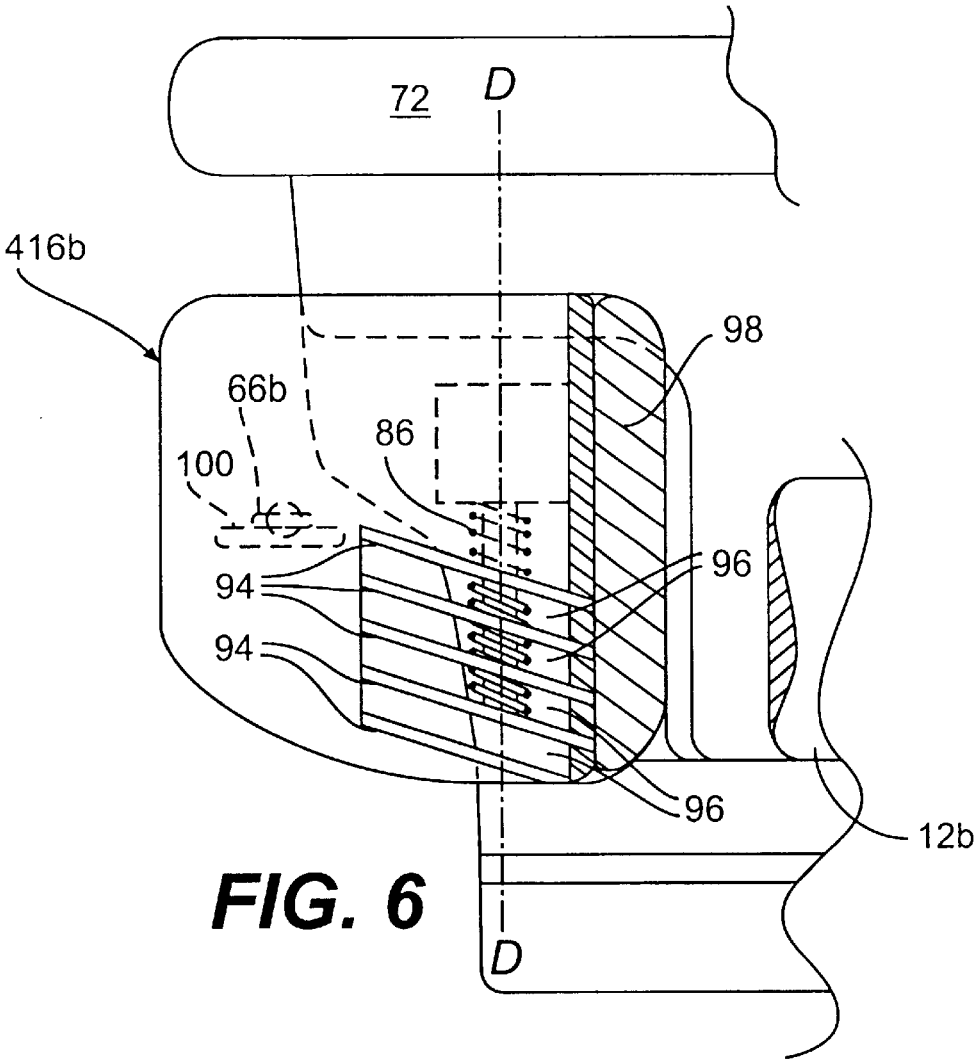
FIG. 6 illustrates a side view in partial section of the third embodiment of the present invention.

As shown in FIG. 5, the rudder 416*b* includes a plurality of fins 94 positioned to catch water when the rudder 416*b* is moved into an operative position. The fins 94 are angled, preferably at 15 degrees, to draw flowing water so that the rudder 416*b* is pulled down further into the water. Alternately, the fins 94 may be disposed at any angle to effect a drawing of water, preferably between about 5 and 25 degrees, but about 15 degrees is most preferred. In other words, when the fins 94 catch the water flowing off the stabilizer or sponson 12*b* and the bottom of the hull, this forces the rudder 416*b* down further into the path of the flowing water to assist in steering PWC 10. FIG. 6 is a side view of the third embodiment of the present invention. The fins 94 are shown. It should be noted that any number of fins can be used, including just one fin, even though a plurality of fins 94 are illustrated. The linking element 66*b* is shown in phantom to illustrate where it connects to rudder 416*b*. A raised nose 98 extends from the forward edge and on both sides of the rudder 416*b* and directs the flow of water around the rudder 416*b*. The nose 98 redirects the water flowing over the rudder 416*b* to prevent water from engaging the fins 94 when the rudder 416*b* is in its inactive position. The rudder 416*b* rotates around axis D—D when activated by the linking member 66*b*. A plurality of openings 96 are located in the areas in between the fins 94 in order to allow water to flow therethrough when rudder 416*b* is in the operative position. Water flows over rudder 416*b* after being directed from the stabilizer 12*b* and the bottom of the hull.

When the rudder 416*b* opens to its operative position, water flows over the nose 98 and flows over the fins 94. The force of the water on the fins 94 causes the rudder 416*b* to move down and compresses the spring 86 to bring the rudder 416*b* into its fully lowered position in the water. Because of the openings 96 integrated between the fins 94, water applies pressure to the fins 94 to force the rudder 416*b* down when the rudder 416*b* is used to steer to the port direction and water flows on the inside surface of the rudder 416*b*. The same is true when the rudder 416*b* steers the PWC 10 to the starboard direction and water flows on the outside surface of the rudder 416*b*.

Figure 7:
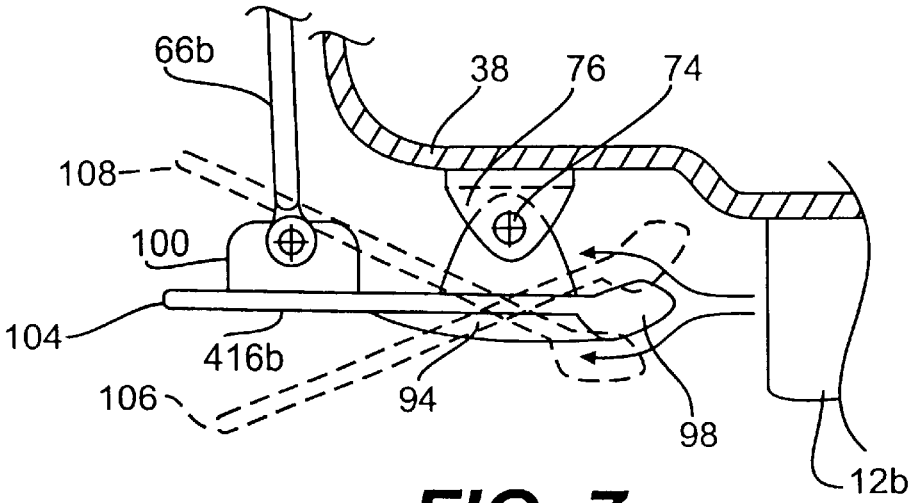
FIG. 7 illustrates the top view in partial section of the starboard rudder of a third embodiment of the present invention.

FIG. 7 illustrates a top view of the various positions of rudder 416*b* (shown in FIG. 6). As discussed earlier with respect to FIG. 5, the rudder 416*b* is spaced away from the hull 38 of the PWC 10. Spacing the rudder 416*b* away from the hull 38 in addition to moving the pivotal location 74 of the rudder 416*b* away from the edge of the rudder 416*b* allows the rudder 416*b* to be used in steering the watercraft either to the port or the starboard direction. For example, rudder 416*b* can be moved into the position shown by 106. In this position, water flowing off of the stabilizer 12*b* will flow over the fins 94 that push the rudder 416*b* down into the water. As the rudder 416*b* moves down into the water, more fins 94 will catch the water and thus further push the rudder 416*b* into the water. The force of the water flowing over the rudder 416*b* will cause the PWC 10 to steer towards the starboard direction. However, if the user wants to steer the PWC 10 towards the port side, the linking element 66*b* will pull the rudder 416*b* into the position shown by the intermittent outline 108. In this position, water flowing off the stabilizer 12*b* and the bottom of the hull will flow across the inside surface of the rudder 416*b*.

The fins 94 are preferably angled at approximately 15° to the horizontal. Other angles may be used also (preferably between 5 and 25 degrees), as long as the fins 94 operate to push the rudder 416*b* into the water against the bias of spring 86 so that the rudder operates to assist in the off-power steering of the PWC 10.

Figure 8:
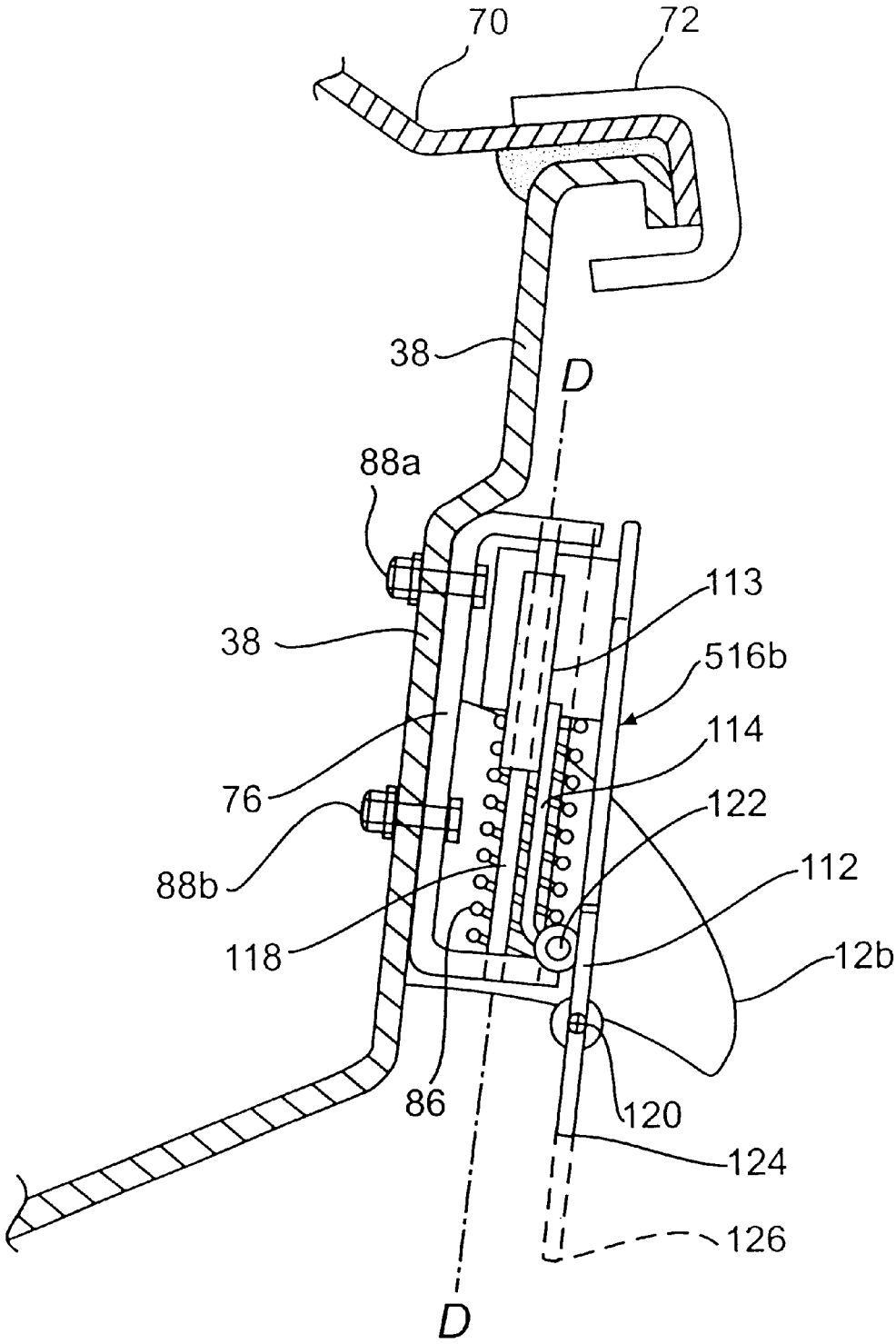
FIG. 8 illustrates a back view in partial section of a fourth embodiment of the present invention.
Figure 9:
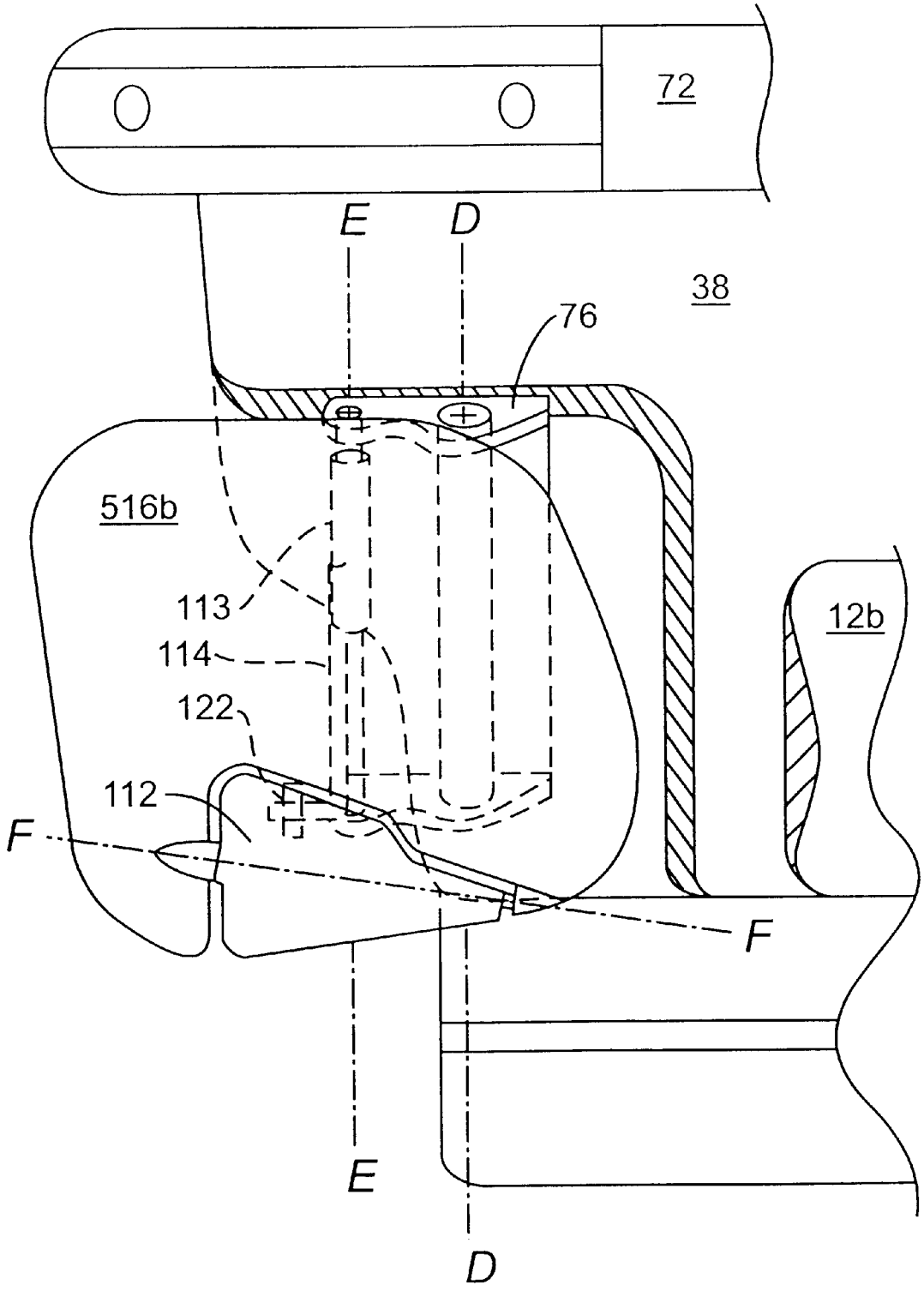
FIG. 9 illustrates a side view in partial section of the fourth embodiment of the present invention.

FIG. 8 illustrates the fourth embodiment of the present invention. According to this embodiment, the rudder 516*b* is attached to the hull 38 via bolts 88*a,* 88*b.* Other means of attachment may also be employed and will be apparent to those of ordinary skill in the art. A spring 86, which may be considered part of the actuator, biases the rudder 516*b* in an upward position 124. In this manner, the rudder 516*b* will normally be in its upward position 124. However, once the rudder 516*b* rotates out into the flow of water, an articulated, rotatable mini flap 112 positioned on the rudder 516*b* will assist in pushing the rudder 516*b* into the water. When the rudder rotates, the mini flap 112 rotates around axis F—F as shown in FIG. 9.

The water flowing over mini flap 112 as the rudder 516*b* is in its operable position causes the mini flap 112 to rotate around axis F—F. A slider 113 attaches element 114, 122 to the top of the mini flap 112 and forces the top of the mini flap 112 to rotate inward when the rudder 516*b* is opened into an operable position in the flow of water. Rotating the mini flap 112 to a certain position in connection with water flowing over the mini flap 112 forces the rudder 516*b* down against the bias of spring 86 and thus pushes the rudder 516*b* down into the water. In this operative position, the rudder 516*b* will be more effective in helping to direct and steer the PWC 10 in off-power conditions.

Figure 10:
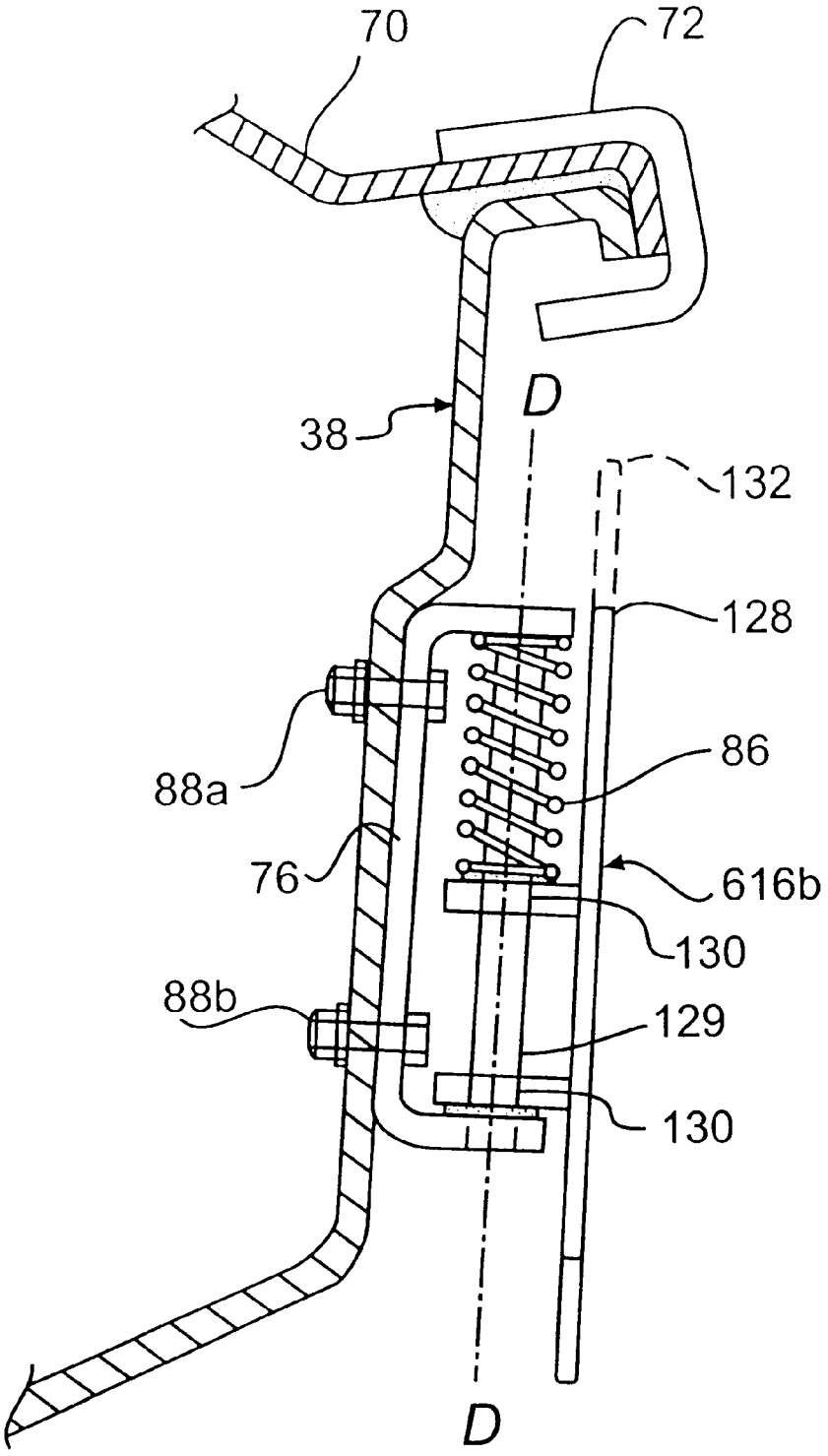
FIG. 10 illustrates a back view in partial section of a fifth embodiment of the present invention.

FIG. 10 shows a fifth embodiment of the present invention and is similar to other embodiments except that the spring 86 biases the rudder 616*b* down into the water rather than up, as was discussed previously. The rudder is labeled in FIG. 10 as 616*b,* but in this and other embodiments, the various illustrations of the rudder systems are interchangeable. For example, the basic rudders 316*a,* 316*b,* shown in FIG. 4, or the variable surface rudders 716*a,* 716*b,* shown in FIGS. 14*a*–14*c,* may be interchangeably used with the various embodiments of the invention.

In the fifth embodiment of the invention, structural elements 130 shown in FIG. 10 connect the rudder 616*b* to a rod 129 and operate to move the rudder 616*b* up or down, also referred to as vertical movement. It is to be understood that any reference to movement in a relative up or down position, especially with respect to the surface of the water, is considered herein to be vertical movement even though it may be at an angle to true vertical.

The rudder 616*b* may be positioned high 132 or low and in water 128. The structural elements 130 enable the rudder 616*b* to pivot around an axis D—D and to move up and down into the upper and lower positions as previously discussed. This embodiment is useful because the rudder 616*b* can be positioned or biased in the water but can be moved out of the water if the watercraft strikes a submerged object or is operating at high speeds, which can cause the hull to ride higher in the water. The rudder configuration of FIG. 10 is preferably used with the clutch system disclosed below with reference to FIGS. 15*a*–15*c* and 16.

Figure 11:
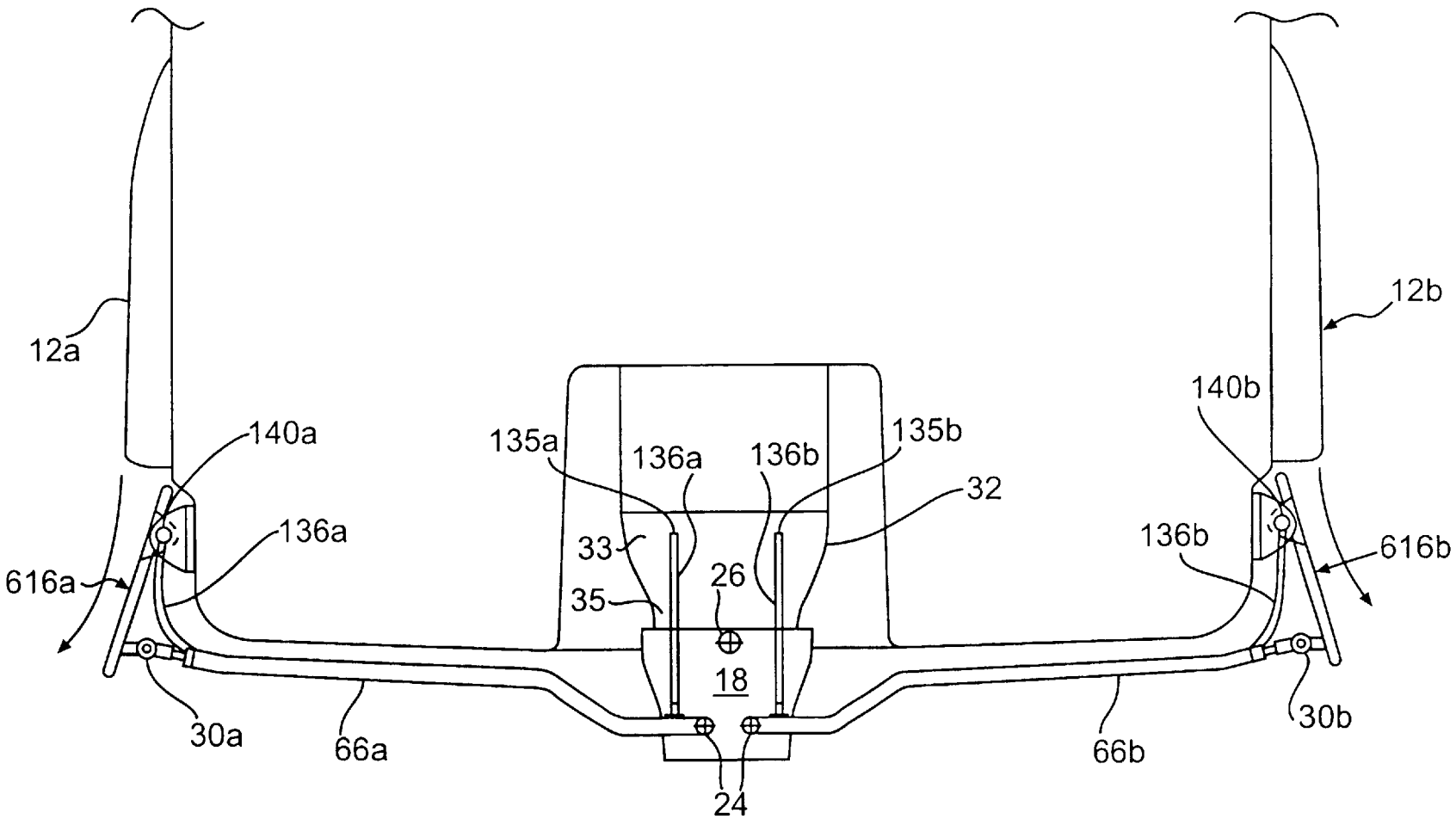
FIG. 11 illustrates a schematic top view in partial section of a sixth embodiment of the present invention.

FIG. 11 shows the sixth embodiment of the present invention. As shown in FIG. 11, water lines 136*a* and 136*b,* which may be considered part of the actuator, are connected to holes 135*a,* 135*b* within the venturi 32. The water lines 136*a,* 136*b* respectively extend from the holes 135*a,* 135*b* in the venturi 32 through the linking elements 66*a,* 66*b* and out near the rudders 616*a,* 616*b.* The rudders 616*a,* 616*b* are connected to the hull via hinged elements 140*a,* 140*b* and the linking elements 66*a,* 66*b* connect the nozzle 18 to rudders 616*a,* 616*b* via hinged elements 30*a,* 30*b.* The rudders 616*a,* 616*b,* are preferably angled inwardly, as shown in FIG. 11, to provide additional deceleration when they are in a lowered operable position. This angle can vary based on the vertical positioning of the rudders. The water lines 136*a,* 136*b* pass through linking elements 66*a,* 66*b.* However, other means of connecting the water lines to the hinged portions 140*a,* 140*b* are also contemplated, including passing the water lines 136*a,* 136*b* through the hull 38 at the stem or attaching them on the outside surface of the hull.

This embodiment obviates the need for a clutch.

Figure 12:
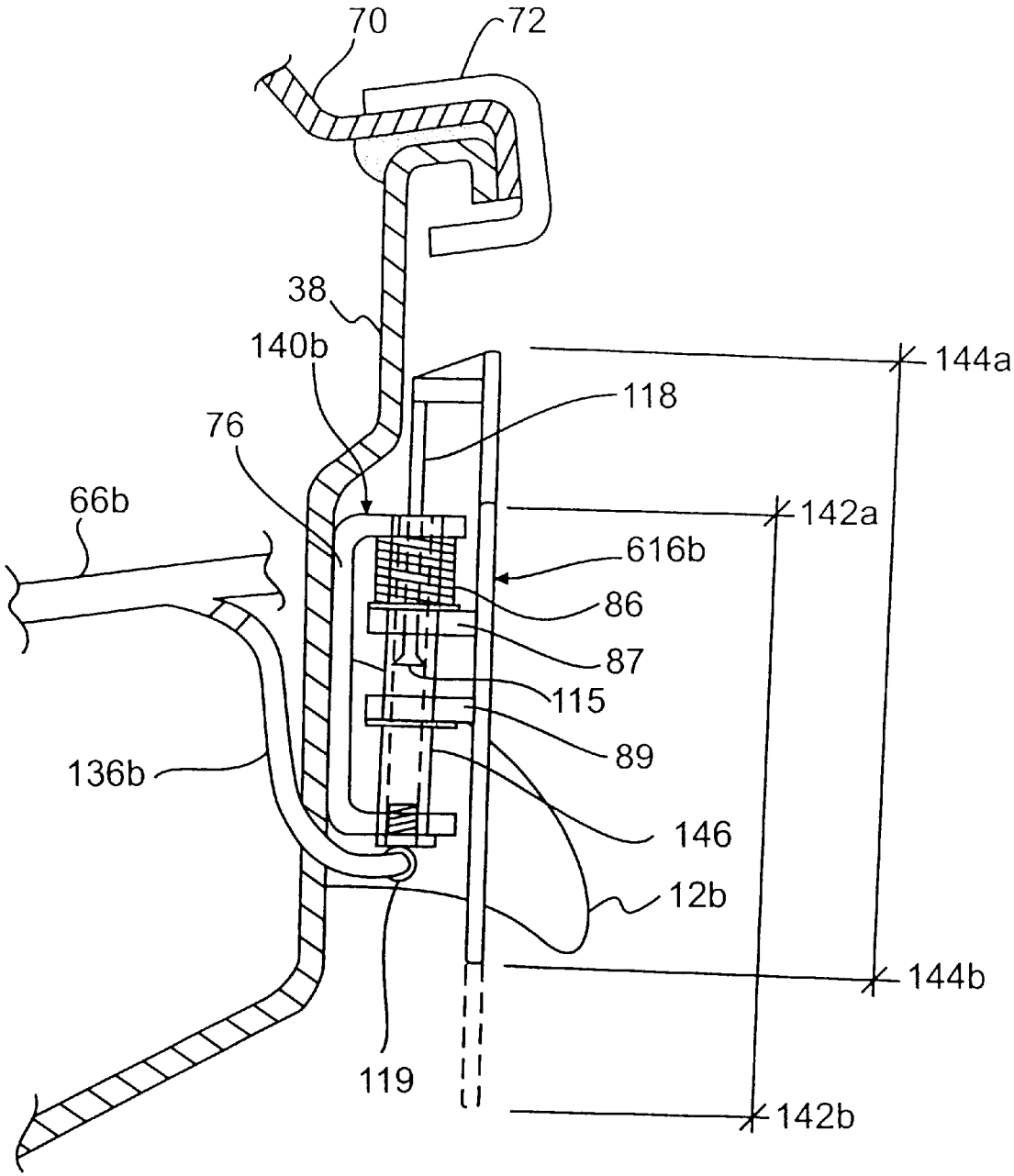
FIG. 12 illustrates a back view in partial section of the sixth embodiment of the present invention.

FIG. 12 provides another view of the preferred embodiment of the present invention. It shows a rear view of the starboard side rudder 616*b.* The connection of the linking element 66*b* to the rudder 616*b* is not shown in order to view the hinge structure of the invention. The hinged portion 140*b* comprises a rod 118, a spring 86, and a water cylinder 146. The water line 136*b* exits from a hollow portion of the linking element 66*b* to a base portion 119 connecting an end of the water line 136*b* to the water cylinder 146. A bracket 76 supports the above-mentioned elements 118, 86, 146 and enables the rudder 616*b* to be securely attached to the hull 38 while being able to both pivot and move vertically. The internal rod 118 has a distal end 115 positioned within the water cylinder 146. The spring 86 biases the rudder 16*b* in a lower position 142*a,* 142*b.* The rudder 616*b* slides up and down the water cylinder 146 via projections 87 and 89 from the inner side of the rudder 616*b.* The projections 87, 89 are attached to the inside surface of the rudder 616*b.* Each projection 87, 89 has an opening complementary to the shape of the water cylinder 146. The projection openings enable the rudder 616*b* to slide up and down the outer surface of cylinder 146.

From this configuration, it can be seen that when biased by the spring 86, the rudder 616*b* is in a lower position such that water flowing off of the stabilizer 12*b* will flow across the rudder 616*b* if the rudder 616*b* is moved into the operable position. Thus, rudder 616*b* is capable of moving from a high position out of the water, shown by extended lines 144*a* and 144*b,* to a lower position 142*a,* 142*b* in the water to assist in steering the PWC 10.

The amount of water pressure within the water cylinder 146 controls the high or low position of the rudder 616*b.* The water pressure in the cylinder 146 depends on the pressure of the water flowing through the venturi 32, as shown in FIG. 11. When the throttle of the PWC is on, water is forced through the venturi 32 and nozzle 18. The water pressure in the venturi 32 varies from a front position to a more narrow rear position. The holes 135*a,* 135*b* in the venturi 32 may be located at various places but preferably are located in the high pressure region. The high pressure region is where water flows more slowly and the diameter of the venturi 32 is larger.

Furthermore, as noted earlier, the venturi/nozzle configuration may vary depending on the PWC. Accordingly, it is contemplated that water lines 135*a,* 135*b* may communicate a water pressure from a location other than the venturi 32, for example from the nozzle 18 or perhaps a speed sensor or water collection port located, for example, under the hull.

When the throttle is on and water pressure in the venturi 32 is high, water is forced through the holes 135*a,* 135*b* into the water lines 136*a,* 136*b.* Water, as shown in FIG. 12, will flow through line 136*b* and begin to fill the water cylinder 146. The water in the cylinder 146 forces the distal end 115 of the piston 118 upward. The piston 118 is connected to the rudder 616*b*, which in turn is connected to the projections 87, 89. As the rudder 616*b* rises, projection 87 contacts and compresses the spring 86 against the spring bias. The rudder 616*b* moves into the higher position shown by 144*a* and 144*b*.

Water in the venturi 32 travels relatively slowly through the wider region 33 of the venturi 32. In this region, although the water travels more slowly, the water pressure is higher. Holes 135*a*, 135*b* are positioned preferably in this high pressure region 33 of the venturi 32. The venturi 32 narrows as it nears the exit portion 35. As the venturi 32 narrows to this region 35, water travels more quickly and the water pressure decreases. Water then is expelled out of the venturi 32 into the nozzle 18 that pivots around pivotal point 26 in order to propel and steer the PWC 10.

In this embodiment, water hoses 136*a*, 136*b* are respectively attached to holes 135*a*, 135*b*. When water is flowing through the venturi 32 at a high rate of speed and the pressure in region 33 of the venturi 32 is high, water is forced out through the holes 135*a*, 135*b* into the respective water lines 136*a*, 136*b*. Linking elements 66*a*, 66*b*, as in previous embodiments, are connected via a pivotal point 24 to the nozzle 18. Pivotal connecting elements 30*a*, 30*b* connect the linking elements 66*a*, 66*b* to the respective rudders 616*a*, 616*b*. On the starboard side, linking element 66*b* connects via pivotal point 30*b* to the nozzle 18 and to the rudder 616*b*. The linking elements 66*a*, 66*b* may be hollow to allow the water lines 136*a*, 136*b* to be inserted therein and thus brought through the linking elements 66*a*, 66*b* near the rudders 616*a*, 616*b*.

On the port side, water line 136*a* extends from the distal end of the linking element 66*a* and connects to the hinged element 140*a*, which attaches a front region of rudder 616*a* to the hull 38 of the PWC 10. Similarly, on the starboard side, the water line 136*b* exits the distal end of linking element 66*b* and connects to the hinged element 140*b*, which connects a forward region of the starboard rudder 616*b* to the hull 38 of the PWC 10. (The hinged portions 140*a*, 140*b* will be shown in more detail below with reference to FIG. 12.) As shown in FIG. 11, as the water pressure increases in the venturi 32 in the high pressure region 33, water is forced into the water lines 136*a*, 136*b* and passes to the hinged elements 140*a*, 140*b* to control the raising and lowering of rudders 616*a*, 616*b*.

Preferably, the rudders 616*a*, 616*b* will be forced into their upper position when the PWC 10 has a jet pump pressure equivalent to the one obtained when the engine is operating at 4500 RPM or more under normal conditions. Below 4500 RPM, the flow of water through the venturi 32 is reduced, and the rudders 616*a*, 616*b* will drop to a lower position proportional to the RPM, for example, approximately 2 inches deep in the water.

When the rudders 616*a*, 616*b* are not needed, i.e., when steering is available through the jet propelled water traveling through the nozzle 18, the rudders 616*a*, 616*b* are positioned high in an inactive position and thus do not drag and slow down the PWC 10. However, when off-power steering is necessary because water is not flowing quickly through the venturi 32, the water pressure in lines 136*a*, 136*b* is reduced. The water in the water cylinder 146 is forced back through the water lines 136*a*, 136*b* and out the holes 135*a*, 135*b*. The rudders 616*b*, 616*a* drop down into position shown by 142*a* and 142*b* and thus come into contact with water flowing off of stabilizers 12*a*, 12*b* to allow the user to steer the PWC 10 at low speeds where such steering assistance is necessary.

According to the present invention, off-power steering can be more efficiently accomplished at low speeds in which the rudders 616*a*, 616*b* will automatically drop from a higher position to a lower position into the water once the water pressure in the venturi 32 reaches a certain level.

The preferred embodiment utilizes the pivotal arrangement of the rudders shown in FIG. 4, which is more efficient because both rudders 316*a*, 316*b* are used in tandem. As is shown in FIG. 4, pivotal points 68*a*, 68*b* are not located at the front portions 67*a*, 67*b* of the rudders 316*a*, 316*b*. Because the pivotal points 68*a*, 68*b* are positioned a certain distance from ends 67*a*, 67*b*, the force necessary to move rudders 316*a*, 316*b* into the flow of water off of stabilizers 12*a*, 12*b* and the bottom of the hull is reduced. In addition to reducing the load on the rudder steering components, the water flow over the rudder is more balanced on each side of the hinge 68*a*, 68*b*.

As shown and discussed earlier, the nozzle 18 directs water flowing from the jet propulsion system in certain directions in order to steer the PWC 10. In the second embodiment shown in FIG. 4, linking elements 66*a*, 66*b* are not telescoping as was shown in the previous embodiment but comprise a single rigid structure. The pivotal elements 24 connect linking elements 66*a*, 66*b* respectively to nozzle 18 allowing the nozzle 18 to pivot when actuated by the steering mechanism at the helm 14. The linking elements 66*a*, 66*b* are respectively connected, via pivotal points 30*a*, 30*b*, to the rudders 316*a*, 316*b*.

In the second embodiment, when the user steers the watercraft, for example, towards the right or starboard direction, the linking element 66*a* pulls the rear portion of rudder 316*a* inward towards the hull 38 and thus positions the rudder 316*a* to allow water to flow on the inner surface of rudder 316*a*. The water flowing off of stabilizer 12*a* thus passes over and is redirected by the inside surface of rudder 316*a*. When turning to the starboard side, pivotal element 24 causes the linking element 66*b* to force rudder 316*b* out into the flow of water coming off of stabilizer 12*b* and the bottom of the hull.

In order to accomplish the result of using both rudders 316*a* and 316*b* in off-power steering, the rudders 316*a*, 316*b* are spaced farther apart from the hull surface 38 than as shown in FIG. 1. As an example, the rudders 316*a*, 316*b* preferably may be spaced about 1.5 inches (about 38.1 mm) from the hull 38. This distance will vary depending on the components used and other factors known to those of skill in the art. For example, the distance may be selected from within a range between about 0.5 and 2 inches (about 38.1–50.8 mm) from the hull. However, any suitable range may be selected based on the configurations and dimensions of the hull.

Both rudders 316*a*, 316*b* participate in the off-power steering of the PWC 10. In addition, the linking elements 66*a*, 66*b* do not need to be telescoping and thus do not have the susceptibility of seizing up or ceasing to operate in the telescoping fashion when used in salt water. Furthermore, single-structure linking elements 66*a*, 66*b* are more cost effective and easier to maintain than their telescoping counterparts. In addition, the embodiment shown in FIG. 4 is easier for the user of the PWC 10 to steer because the pivotal point of rudders 316*a*, 316*b* is moved a certain distance from the ends 67*a*, 67*b* of rudders 316*a*, 316*b*. In this manner, since the fulcrum of the pivoting point of rudders 316*a*, 316*b* is moved into a position offset from the edge of the rudder, it is much easier for the driver of the PWC 10 to steer. The linking elements 66*a*, 66*b* operate on the rearward edges of rudders 316*a*, 316*b* making it easier for these rudders 316*a*, 316*b* to be forced out into the flow of water off of stabilizers 12*a*, 12*b*.

The other embodiments also address these problems discussed above, namely the lack of efficiency of the hinged rudder system, the strain of the vertical rudder system on the steering components, the drag of the rudders or rudders when they are in the lower position, and the negative aspects of the combined effect of the nozzle and rudders in a steering operation.

While FIG. 4 and FIG. 11 show the linking elements 66*a*, 66*b* and water lines 136*a*, 136*b* on the outside of the hull, other configurations are also contemplated. A double wall of fiberglass built inside the hull 38 near the stem portion may also be used to pass both the linking elements 66*a*, 66*b* and the water lines 136*a*, 136*b* to the rudders 616*a*, 616*b*. In this case, the linking elements 66*a*, 66*b* and water lines 136*a*, 136*b* would be out of sight from the rear of the PWC 10. Bushings would likely be used in the sidewalls where the linkages 66*a*, 66*b* come through the hull 38. Other configurations and structures for connecting the water lines 136*a*, 136*b* and linking elements 66*a*, 66*b* to the rudders 616*a*, 616*b* also will be recognized by those skilled in the art. For example, a tubular cover can be provided over the linking elements and water lines.

Figure 13:
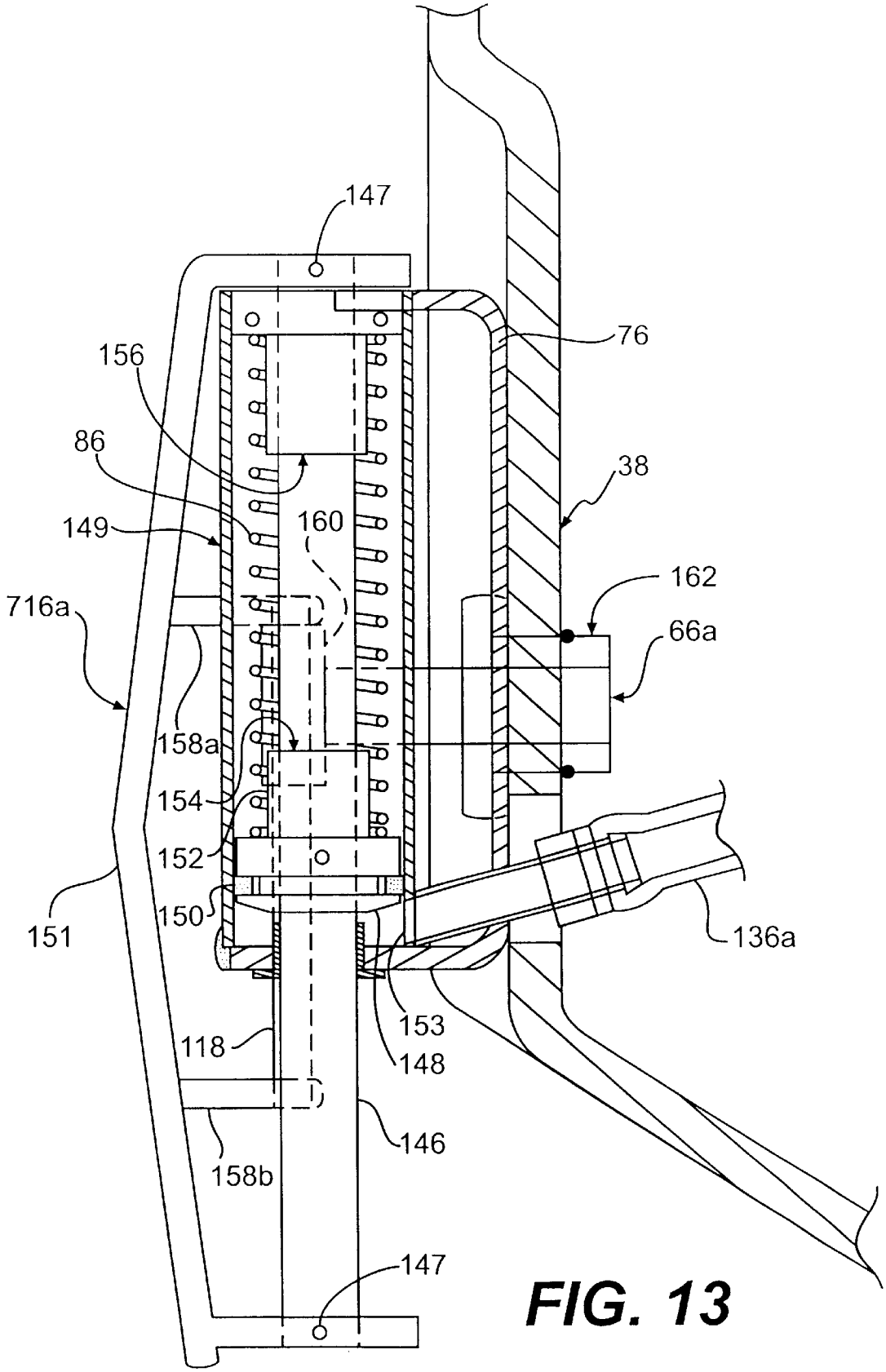
FIG. 13 illustrates a back view in partial section of a variation of the sixth embodiment of the present invention with a modified rudder.

FIG. 13 illustrates a variation of the sixth embodiment of the present invention. FIG. 13 shows the portside rudder 716*a*. The rudder 716*a* has a modified structure on its surface, shown generally at 151. The special structure of the rudder 716*a* will be described below with respect to FIGS. 14*a*–14*c*. As shown in FIG. 13, piston 146 is connected to the rudder 716*a* using a spring pins 147 at both ends of the rudder 716*a*. The piston 146 has a head portion 148 that is encased within a water cylinder 149. An opening 153 in the water cylinder 149 provides a fluid connection to the water line 136*a* which, as discussed earlier, is connected to an opening 135*a* in the venturi 32. The piston 146 and cylinder 149 may be considered part of the actuator.

When the water pressure increases in the venturi 32, water flows in the water line 136*a*, through the opening 153 and into the water cylinder 149. Water is trapped within the piston region below the head 148 via a plastic O-ring 150 and the head 148 of the water cylinder 149. Water flowing into the cylinder 149 causes the piston 146 to rise and which thus lifts the rudder 716*a* up and out of the water.

As in earlier embodiments, a biasing spring 86, which may be considered part of the actuator, biases the rudder 716*a* in the down position. Further, part of the head 148 of the piston 146 has an annular surface 154. When the piston rod 146 rises due to water pressure entering the cylinder 149, the annular surface 154 will contact an annular surface of an upper bushing 156 indicated at an upward portion of the water cylinder 149, which impedes the movement of the piston 146. The spring 86 is seated on the bushing 156. A bracket 76 attaches the water cylinder 149 to the hull 38 of the PWC 10. In another region of the rudder 716*a* is an attachment 158*a*, 158*b* that connects the backside of rudder 716*a* to a rod 118. Shown in phantom, the rod 118 is surrounded by a sleeve 160 that is connected to a distal end of the linking element 66*a*.

In this manner, the rudder 716*a* can pivot around an axis extending along the piston 146 while allowing the rudder 716*a* to also raise up and down wherein the sleeve 160 slides over the pin 118 as the rudder 716*a* moves up and down according to the water pressure which is in the water line 136*a*. An opening in the hull 38 or in some other equivalent structure, such as a bushing 162 mounted to the hull, may allow for the support of the linking element 66*a*.

To avoid building up too much water pressure in the water cylinder 149, and to assist in washing and cleaning, the piston 146 and/or water cylinder 149 may leak water purposefully. At least one hole and preferably four evacuation holes (not shown) may be placed in the top region of the water cylinder 149 for this purpose.

Figure 14A:
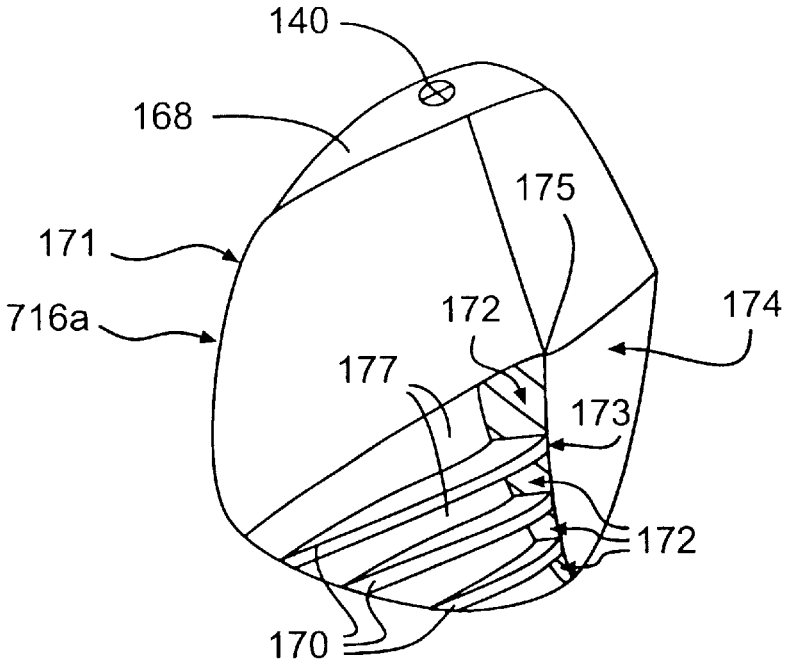
FIGS. 14*a* through 14*c* illustrate various partial perspective views of the rudder according to the sixth embodiment of the present invention.
Figure 14B:
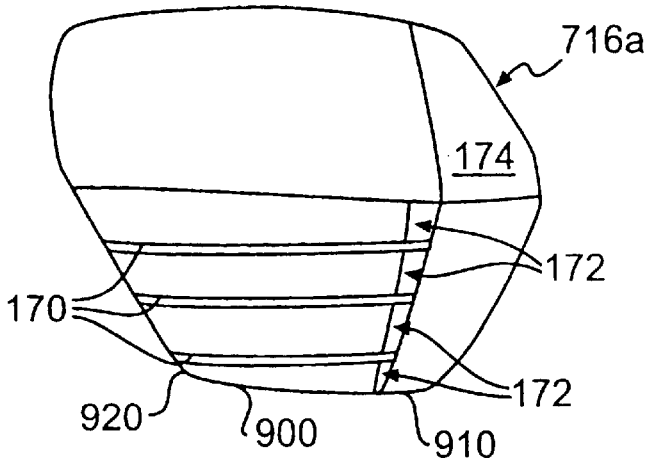
Figure 14C:
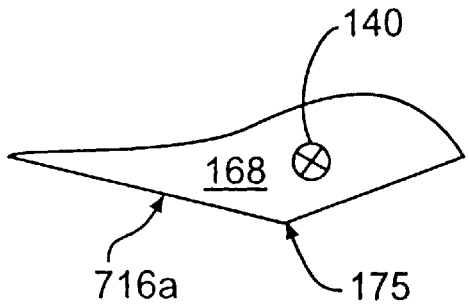

FIGS. 14*a* through 14*c* are perspective views of the rudder 716*a*. Turning first to FIG. 14*a*, the surface of rudder 716*a*, as illustrated generally by 174, comprises various elevations that, in the preferred embodiment, peak at a point indicated by 175. Furthermore, the rudder 716*a* comprises a plurality of openings 172 on its face. These openings 172 are bounded by portions of the rudder 716*a* and also fins 170 that connect the front surface structure of the rudder to a deeper structural surface of the rudder indicated by 173 and 177, respectively. The fins 170 also act as structural reinforcement for the rudder 716*a*. Angling the fins 170 will assists in moving the rudder 716*a* into the water, as described in the third embodiment. At a top portion of the rudder 716*a* is a flat extension 168 which provides a connecting means for the pivoting point 140 in order to enable the rudder 716*a* to pivot and assist in steering the PWC 10.

FIG. 14*b* is another perspective view showing the openings 172 and the fins 170. The surface 174 of the rudder 716*a* is also shown. The openings 172 enable the rudder 716*a* to be turned in such a way that it may be effective in diverting water either on its outside surface 174 or on an inner surface indicated generally by 171 in FIG. 14*a*. Thus, the rudder 716*a* is turned about the axis such that water flows across the inside surface 171. Water can flow through the openings 172 and across the fins 170 both to relieve pressure upon the rudder 716*a*, which may weaken it unnecessarily, and to allow the rudder 716*a* to participate in diverting enough water to assist in steering the PWC 10. However, in the same regard, if rudder 716*a* is turned in such a way, for example, toward the port side to assist the PWC 10 in steering to the port direction, then water will flow across the front surface of rudder 716*a* illustrated at 174. In such a case, water will flow over the front surface 174 and over the surface 177 and out the back of the rudder 716*a*. In this manner, the rudder 716*a* may more fully participate in steering the watercraft whether water flows across either the front surface 174 or the rear surface 171 of the rudder 716*a*.

The leading edge 910 of the bottom surface 900 of the rudder 716*a* curves upwardly to deflect floating obstacles, such as a rope, under the rudder 716*a*, or to help moving the rudder 716*a* up over solid obstacles, such as a rock, to avoid entangling or damaging the rudder 716*a*. The trailing edge 920 of the bottom surface 900 of the rudder 716*a* curves upwardly as well. This curve accelerates the flow of the water following the bottom surface 900, thus creating a low pressure region. This low pressure region assists in moving the rudder 716*a* into an operative position.

FIG. 14*c* illustrates a top view of rudder 716*a*. The hinged connection 140 is illustrated as the point around which the rudder pivots. FIG. 14*c* provides a general understanding of the shape of the top surface 168. The top surface 168 preferably has an airfoil shape to increase the efficiency of the rudder 716*a* when turning. However, this shape shown in FIGS. 14*a* through 14*c* is not necessarily meant to be limiting but is only exemplary of possible configurations and locations of cavities or openings 172 within the rudder 716*a* that help direct water over surfaces or through the rudder where necessary. It is contemplated that other configurations may be available or used in connection with these general ideas.

Figure 15C:
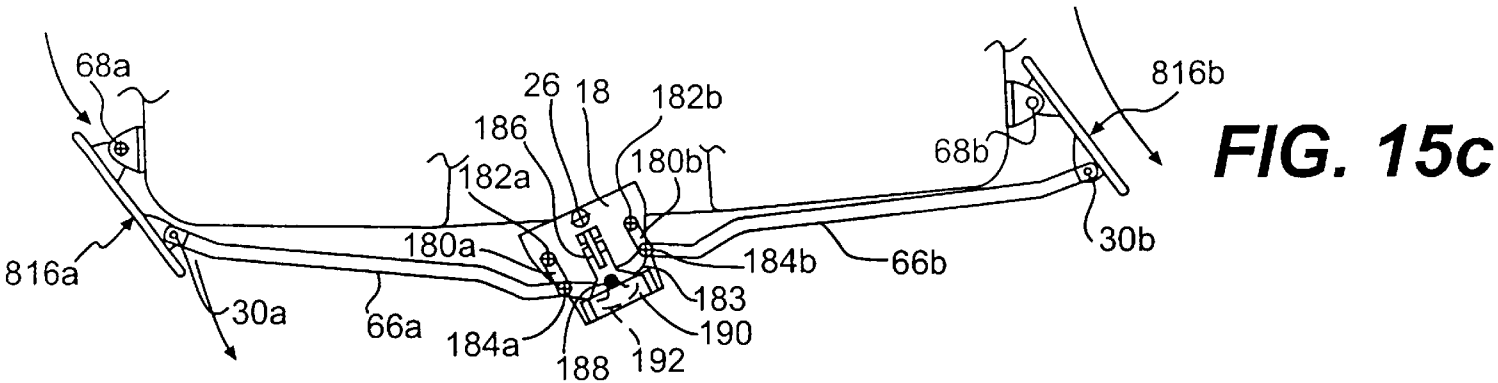
FIGS. 15*a* through 15*c* illustrate a seventh embodiment of the present invention from a top view.
Figure 15B:
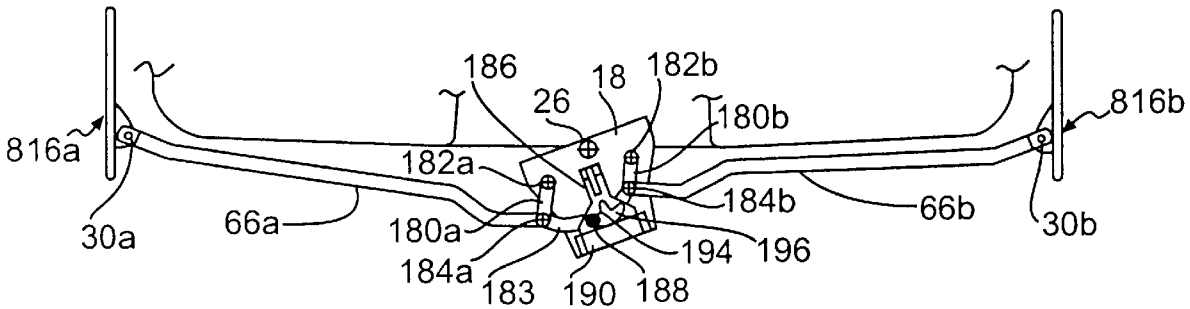
Figure 15A:
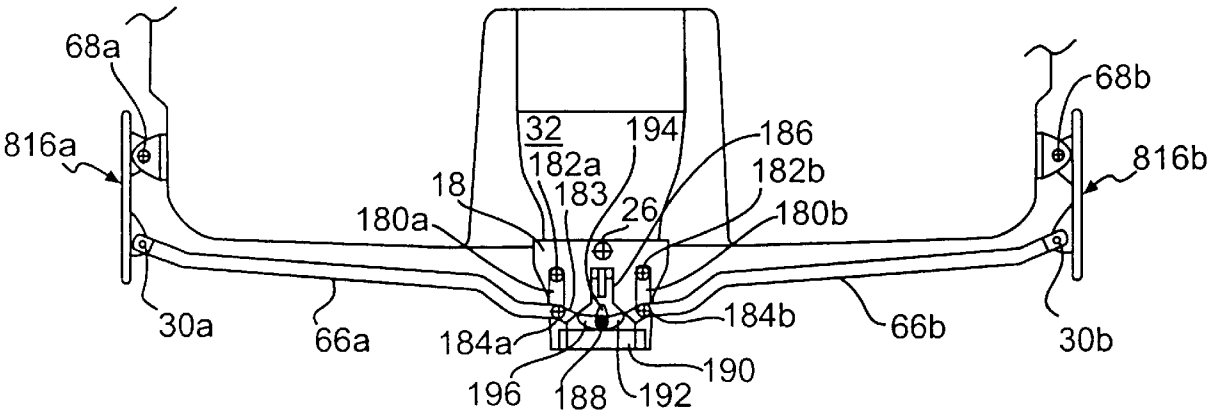

FIGS. 15*a* through 15*c* illustrate a seventh embodiment of the present invention. As in earlier embodiments, the rudders

816*a* and 826*b* are connected via hinged portions 68*a* and 68*b* to the hull 38 at a location spaced a certain distance from the end of the rudders 816*a*, 816*b*. This offset position, which places the fulcrum away from the end of the rudders 816*a*, 816*b*, makes it easier to force the rudders 816*a*, 816*b* out into the flow of water. FIGS. 15*a* through 15*c* illustrate a clutch mechanism, which may be considered part of the actuator, in which both rudders 816*a*, 816*b* may be moved simultaneously in order to assist in steering during throttle operation. Furthermore, in this embodiment, using the clutch system enables both rudders 816*a* and 816*b* to remain inoperative when they are not needed for steering purposes. The rudders 816*a*, 816*b* may be any of the rudder embodiments disclosed herein or other configurations.

As shown in FIG. 15*a*, a slider 186 includes a slot opening 192. While slider 186 and the clutch mechanism are shown on top of the nozzle, the clutch system could also be below the nozzle. The slot opening 192 includes two regions 194, 196 for receiving a locking pin 188. When the pin 188 is in the first unlocked region 196, the pin 188 slides and does not engage the slider 186. The second locking region 194, is discussed below. The clutch system further comprises a pair of brackets 180*a*, 180*b* connected to pivotal attachments 182*a*, 182*b* to the nozzle 18. Bracket 180*a* is attached at one end by pivotal attachment 182*a* to the nozzle 18 and, at the other end, is attached to linking element 66*a* via a pivotal attachment at 184*a*. Bracket 180*b* is attached to the nozzle 18 at pivotal attachment 182*b* at one end and is attached to linking element 66*b* at pivotal attachment 184*b* at the other end.

The locking pin 188 is attached to a transverse bracket 183 which is connected at one end to pivotal point 184*a* and at the other end of pivotal point 184*b* which, as previously discussed, are respectively attached to brackets 180*a*, 180*b* and linking elements 66*a*, 66*b*. When the locking pin 188 is not engaged with the slider 186, or the locking pin 188 is in the non-engaging portion of the opening 196, as illustrated in FIGS. 15*a* and 15*b*, movement of the nozzle 18 will not cause the rudders 816*a*, 816*b* to move.

The non-engaged mode of operation is further illustrated in FIG. 15*b*. In FIG. 15*b*, the pin or bolt 188 is allowed to slide through the slider opening 196 as the nozzle 18 is moved back and forth. As the pin 188 slides through the lower region of opening 196, it does not engage the transverse element 183 in order to affect the motion of movement of rudder 816*a*, 816*b*. In this non-engaging mode, the slider 186 does not engage the pin 188 and is not set within the cover 190. The brackets 180*a*, 180*b* prevent the linking elements 66*a*, 66*b* from moving the rudders 816*a*, 816*b* into inactive, inoperative or undesired positions. In this mode, the nozzle 18 moves left or right without moving the rudders 816*a*, 816*b* since locking pin 188 is not engaged in the engaging portion 194 of the slot opening 192 within the slider 186. This is because the slider 186 moves freely to the left and right in connection with the movement of the nozzle 18, but does not engage the locking pin 188 and thus does not engage the linking elements or the movement thereof in order to actuate the rudders 816*a*, 816*b*.

FIG. 15*c* illustrates the locking pin 188 engaged with the cavity 194. When the transverse element 183 is engaged via locking pin 188 to the slider 186, it enables the linking elements 66*a*, 66*b* to move as the nozzle 18 rotates around pivotal point 26. In this manner, both rudders 816*a*, 816*b* simultaneously rotate around their respective hinges 68*a*, 68*b* since they are connected to the non-telescoping structures of the linking elements 66*a*, 66*b*.

Figure 16:
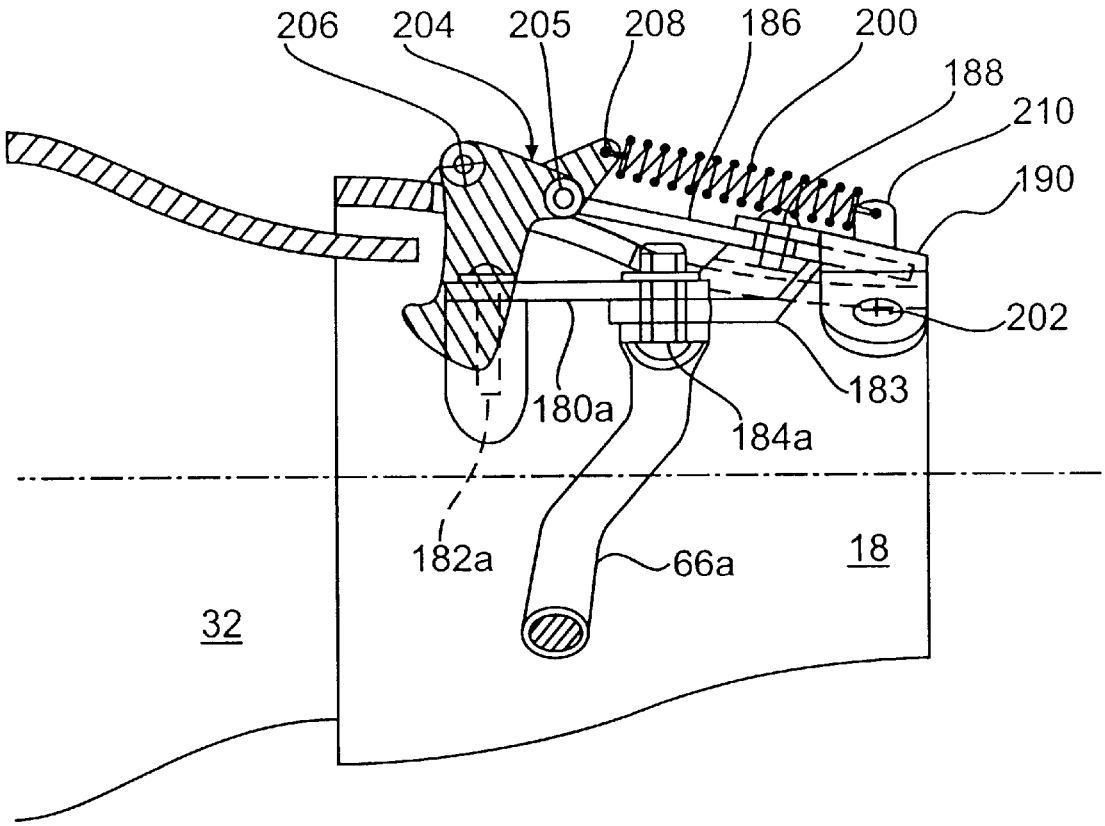
FIG. 16 illustrates the seventh embodiment of the present invention from a partial side view.

FIG. 16 illustrates a side view of the clutch mechanism disclosed in FIGS. 15*a* through 15*c*. A nozzle rudder 204 is positioned inside the nozzle 18 and is approximately 3 mm wide. The linking element 66*a* and pivotal connecting portion 184*a* are connected and stacked with the bracket 180*a* and transverse connecting element 183. Also, the cover portion 190 covers a portion of the slider 186 in the linked position. In addition, the nozzle rudder 204 is pivotally attached to the nozzle 18 at a pivot point 206 and an extension flange 208 extends from the top of the nozzle rudder 204. A spring 200 is attached at one end to the flange 208 and biases the rudder 204 down in the water. When the speed of the water, i.e., the dynamic pressure of the water, is high enough, the water causes the rudder 204 to rotate around pivotal axis 206. Preferably, the rudder 204 would be fully positioned at a dynamic pressure corresponding to a motor speed of between about 3500 and 5500 RPM under normal operating conditions. Most preferably, the locking pin 188 disengages the opening 194 when the dynamic pressure corresponds to a motor speed of about 4500 RPM under normal operating conditions.

Spring 200 is connected at its other end via a flange 210 to cover 190. Cover 190 is attached to the nozzle 18 through a screw or similar attachment means 202. When water flows through the nozzle 18 at high speeds, the water will force the nozzle lever 204 rearward in the same direction as the water flow. The effect of the flow of water through the nozzle 18 causes the nozzle lever 204 to pivot about point 206 and to draw forward the slider 186 thus causing the pin 188 to engage the slider opening 196. This prevents the linking element 66*a*, 66*b* from causing the rudders 816*a*, 816*b* to pivot out into the path of the water and thus participate in steering the PWC 10.

The locking pin 188 is mounted on the transversal link 183 that is connected at both ends to the linking elements 184*a*, 184*b*, respectively. The transversal link 183 connects the left and right rudders 816*a*, 816*b* and linkage elements 66*a*, 66*b* such that when the locking pin 188 is not engaged, the locking pin 188 is free to move sideways back and forth without manipulating the rudders 816*a*, 816*b*. To engage the rudders 816*a*, 816*b*, the spring 200 stiffness can be adjusted so that the nozzle rudder 204 will move into its fully down position when the water pressure corresponds to the speed of the motor reaching 2500 RPM under normal operating conditions. When the nozzle rudder 204 is down, the slider 186 is in its rear position and the locking pin 188 is engaged in the locking portion 194 of slot opening 192.

The shape of the slot opening 192 can be modified or adjusted to vary the corresponding motor speed range (RPMs) in which the rudders 816*a*, 816*b* are engaged by the clutch mechanism. Preferably, the locking pin 188 engages the locking portion 194 of the opening 192 when the corresponding motor speed is between 3000 and 4500 RPM. It is also contemplated that the shape of the slot opening 192 could be inverted to engage locking pin 188 at pressures corresponding to high motor speeds only. Such a clutch mechanism could also be used in systems other than off-power steering systems, such as a trimming system or any other suitable system known to one skilled in the art.

Figure 17:
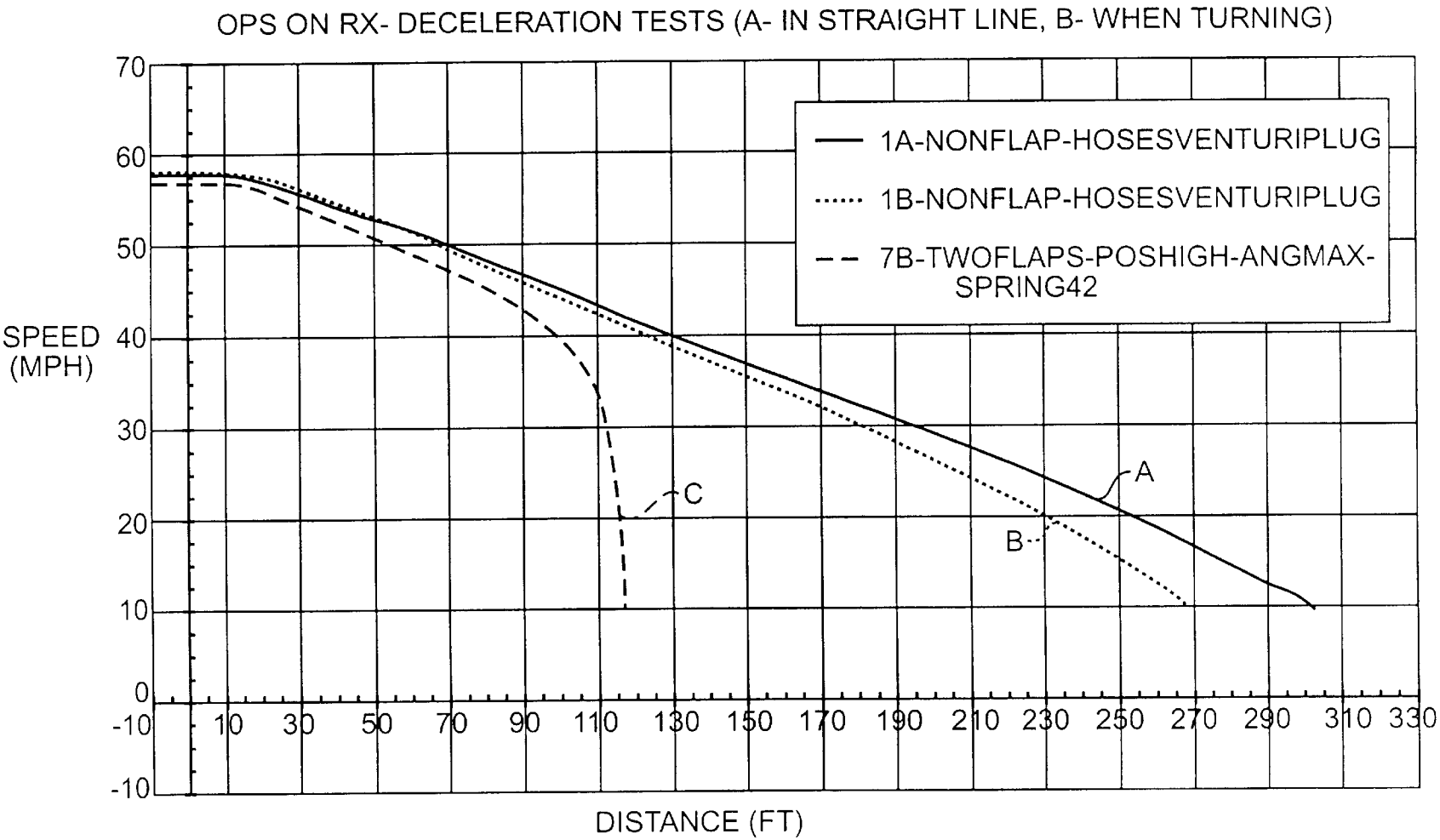
FIG. 17 shows a chart comparing the various distances necessary to stop and turn a PWC operating with and without flaps.

FIG. 17 illustrates results of fields tests performed on PWCs and shows the effect of flaps/rudders or no flaps/rudders and of either driving straight or turning while decelerating the PWC. The tests were performed using the rudder configuration shown in FIGS. 14 and 18. The speed and miles per hour are on the vertical axes and the distance in feet it took the PWC to decelerate from a speed of around 58 mph down to 10 mph are on the horizontal axes. Line A illustrates no rudders being used and the PWC traveling in a straight line. In this case, approximately 300 feet were required for the PWC to slow from a speed of 58 mph to 10 mph. Line B shows that it took approximately 270 feet for a PWC to slow from 58 mph to 10 mph when no rudders were used and the PWC was turned at the same time as it was decelerating.

Line C illustrates the effect of having two rudders starting in a raised position and activated to lower into the water and turning the PWC while slowing. In this case, it took approximately 160 feet for the PWC to slow from a speed of 58 mph to 10 mph. This is similar to the stopping distance of a car. FIG. 17 illustrates the great advantages of using rudders according to the present invention in order to assist in decelerating the PWC.

Figure 18:
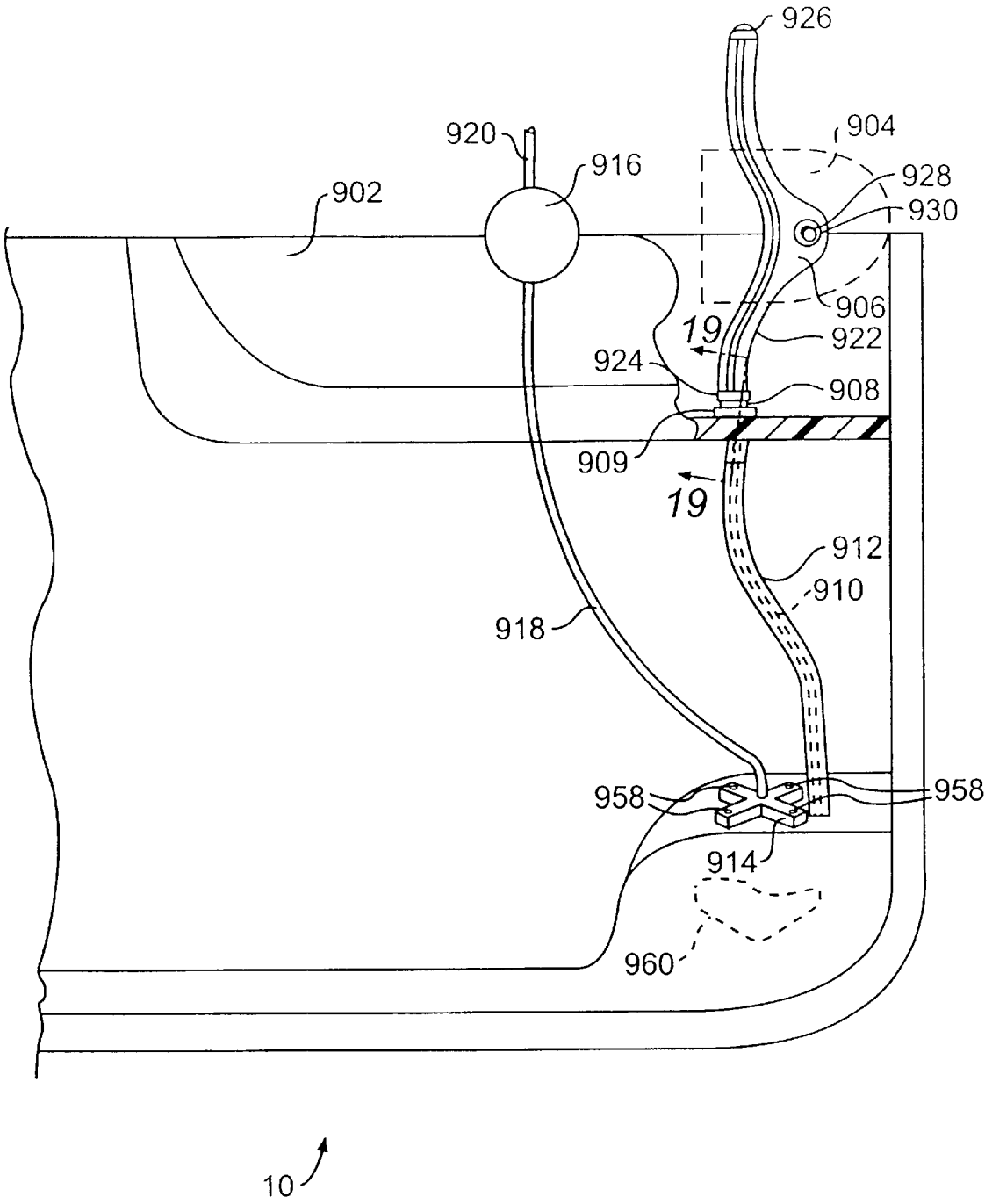
FIG. 18 is a top view of the port half of a PWC with the deck removed and a portion of the tunnel cut away, the view illustrating an eight embodiment of the invention.

FIGS. 18–24 show an eighth embodiment of the invention. In this eighth embodiment, the PWC 10 has an alternative construction for connecting the nozzle 904 to the rudders. FIG. 18 is a top view showing only one lateral half of the PWC 10 and with the deck removed. Also, the rearward portion of the tunnel 902 is cut away and the nozzle therein is shown schematically at 904. In FIG. 18, a U-shaped bracket 906, a generally vertically extending flexible member 908 made from Delrin®, a through-hull fitting 909, a rigid stainless steel rod 910 housed in a rubber tube 912, an X-shaped bracket 914, a fluid T-connector 916, and a pair of rubber hoses 918, 920 are all shown. Each of these components may be considered part of the actuator.

The nozzle 904 is pivotally mounted for directing the pressurized stream of water to provide steering in the same manner as described above or in any other suitable manner. The U-shaped bracket has a laterally extending portion 922 with a pair of vertically extending portions 924, 926 on opposing ends thereof. The center of the laterally extending portion 922 is pivotally connected to the underside of the nozzle so that pivotal movement of the nozzle shifts the U-shaped member 906 generally laterally. Specifically, pivoting the nozzle 904 clockwise shifts the U-shaped member 906 laterally to the port side of the PWC 10. Likewise, pivoting the nozzle 904 counterclockwise shifts the U-shaped member 906 laterally to the starboard side of the PWC 10. The U-shaped member is pivotally connected to the underside of the nozzle 904 by a single bolt 928 inserted through a bore in the general center of the laterally extending portion 906. A sleeve 930 is received around the bolt 928 and abuts against the underside of the nozzle 904. The U-shaped member 906 can slide vertically along the exterior of the sleeve 930 so that vertical force components applied to the U-shaped member 906 are not transmitted directly to the nozzle 904.

Figure 19:
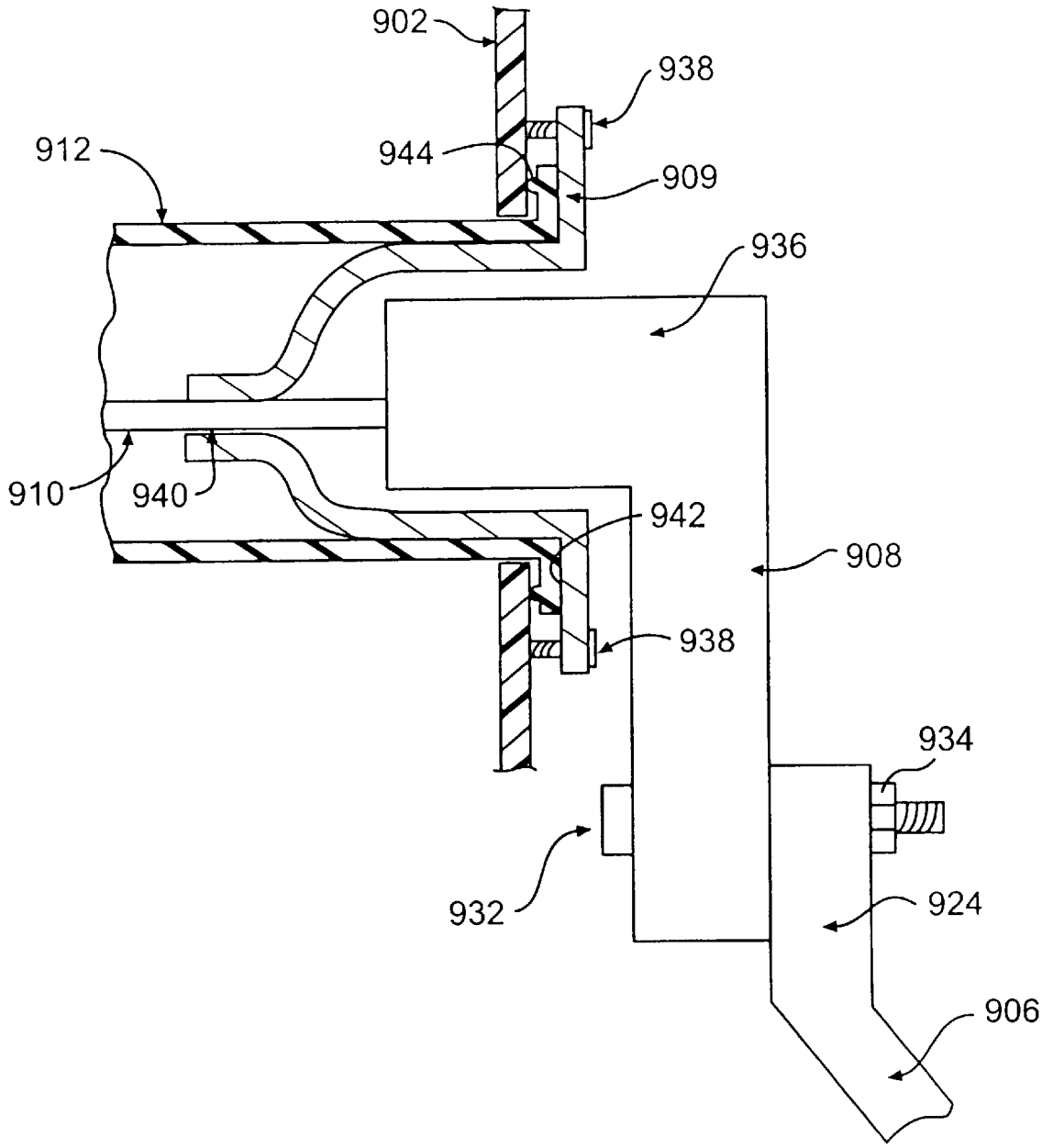
FIG. 19 is a partial sectional view taken along line 19—19 in FIG. 18.

FIG. 19 shows the manner in which the U-shaped member 906 is connected to flexible member 908 and the manner in which the flexible member 908 is connected to rod 910. An identical construction for interconnecting these elements is provided on the starboard side of the U-shaped member 906. The vertical portion 924 of the U-shaped member 906 has a bore therethrough and the lower end portion of the flexible member 908 has a bore therethrough. These bores are aligned and a threaded bolt 932 is inserted through the aligned bores. The bore in the flexible member 908 is counterbored and a wear resistant washer is received in the bore adjacent the head of the bolt 932 to facilitate pivotal movement. A nut 934 is threaded onto the bolt 932 and tightened. This pivotally connects the flexible member 908 to the U-shaped member 906. The pivotal connection allows for some relative movement to occur between the U-shaped member 906 and the flexible member 908.

The flexible member 908 has a perpendicularly extending portion 936 at the upper end thereof. Portion 936 has a threaded bore (not shown) formed therein. The sleeve 912 is inserted into a hole in the vertical wall of the tunnel 902 and has a flange 942 extending radially therefrom inside the tunnel 902. The flange 942 has an annular sealing ridge 944. The fitting 909 is inserted from the tunnel interior into the open end of sleeve 912 and is secured to the tunnel wall by a series of bolts 938. The fitting 909 holds the flange 942 of tube 912 against the tunnel wall so that the ridge 944 provides a seal to substantially prevent water from leaking from the tunnel interior into the main hull cavity. The fitting 909 has a bore 940 extending therethrough. The perpendicular portion 936 of the flexible member extends partially into the bore 940 from the tunnel interior. The rod 910 extends through the tube 912, into the bore 940, and is received in the bore formed in the perpendicular portion of the flexible member 936. The end of the rod 910 is threaded so that the rod 910 is retained in the perpendicular portion's bore by threaded engagement. A low friction tape, such as conventional masking tape, is wrapped around the threads of the rod so that some rotational play can occur between the rod 910 and the flexible member 908. By this connection, as the U-shaped member 906 moves laterally during the pivotal movement of the nozzle 904, the rod 910 will be pushed/pulled within the sleeve 912, as dictated by the movement of the nozzle 904 and the U-shaped member 906.

Figure 20:
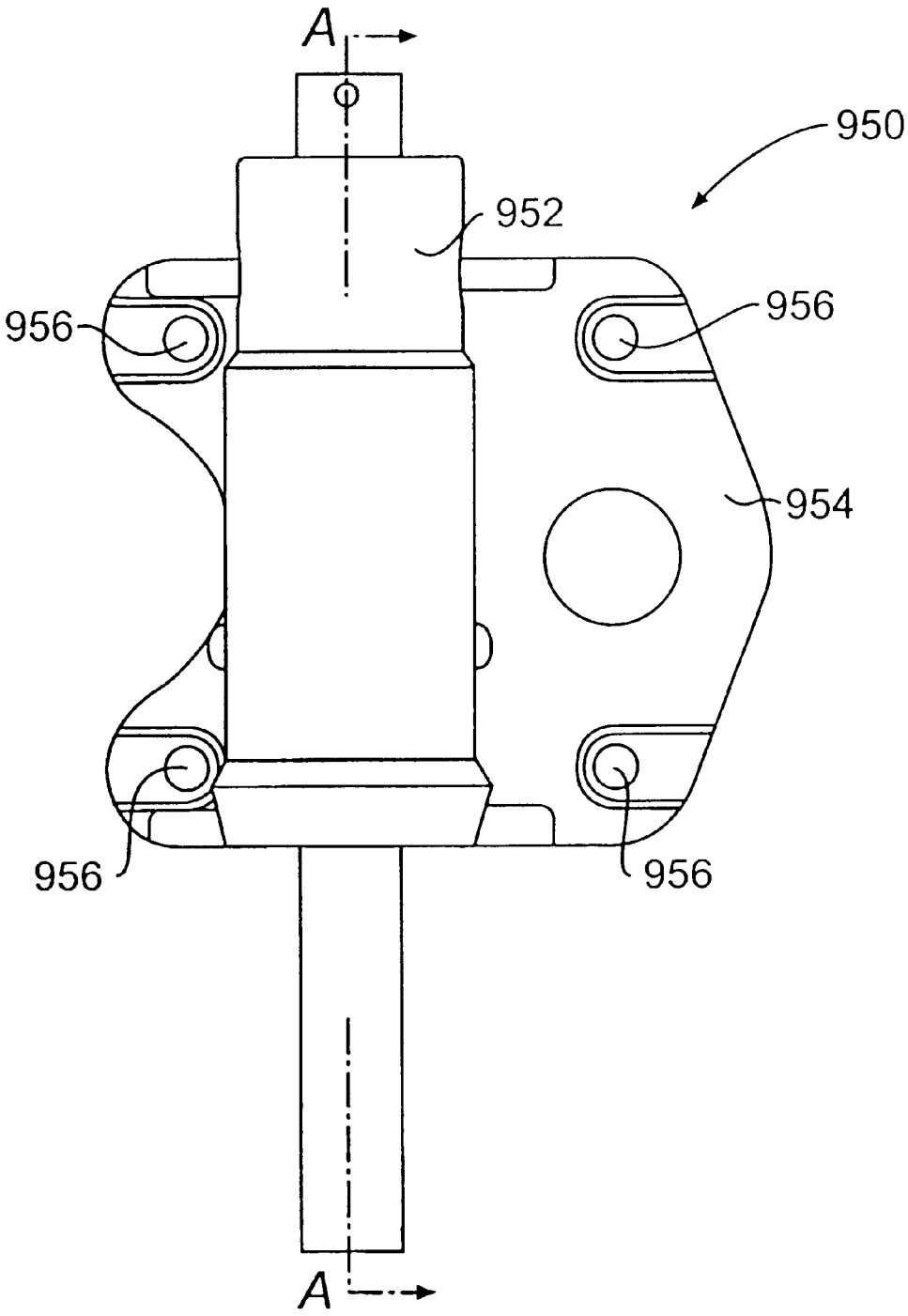
FIG. 20 is an elevated view of a piston/bracket unit used in the eighth embodiment of the invention.

FIGS. 20 and 21 show an integrated piston/bracket unit 950, which comprises a piston assembly 952 and a bracket 954. The bracket 954 has four mounting bores 956, a piston fluid port 955 extending from the inner surface thereof, and a rod receiving portion 957 extending from the inner surface thereof. Four bores corresponding to mounting bores 956 are formed on the outer wall of the hull and the X-bracket 914 has another set of four corresponding mounting bores. The X-bracket also has a center mounting bore and the hull has a corresponding mounting bore centered with respect to its other four bores. To connect the brackets 914 and 954 to the hull, the X-bracket 914 is placed on the inner surface of the hull with its mounting bores aligned with the hull bores and a bolt is inserted through the X-bracket center bore and the hull center bore to initially mount the bracket 914 with the other four hull bores and the other four bracket bores aligned. The bracket 954 (along with the entire unit 950) is then placed on the exterior surface of the hull with the mounting bores aligned with the four hull bores and the four X-bracket bores. Four bolts 958 (FIG. 18) are then inserted through these aligned bores to attach the brackets 914 and 954 to the hull wall. A soft rubber sealing member 959 is provided on the inner surface of the bracket 954 to reduce the chances of any water from leaking into the hull through the hull bores. Two additional bores are provided in the hull wall for connecting the rod 910 to the rudder 960 and the hose 918 to the piston assembly 952, including one bore spaced rearwardly from the X-bracket 914 and one bore spaced below from the X-bracket 914. The piston fluid port 955 extends through the bore below the X-bracket 914 into the interior of the hull for connection to hose 918. The hull bore spaced rearwardly from the X-bracket 914 has the rod receiving portion 957 extends therethrough when the unit 950 is mounted.

Figure 22:
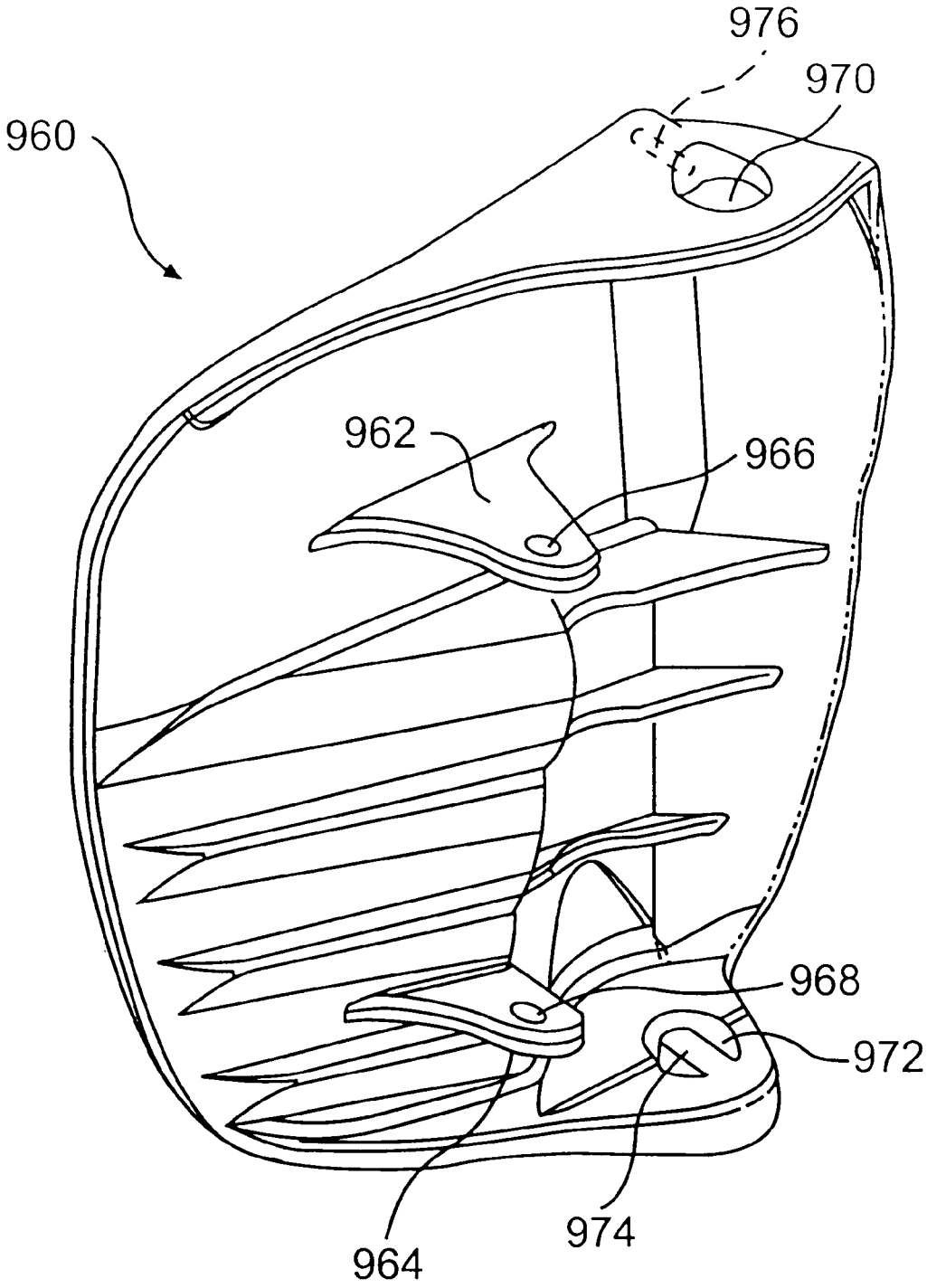
FIG. 22 is a perspective view of a rudder used in the eighth embodiment of the invention.

FIG. 22 shows a rudder 960. The rudder 960 has a construction generally similar to those discussed above and thus it will not be discussed in detail, with the exception of a brief discussion of how it attaches to the piston/bracket unit 950. The rudder 960 has a pair of tabs 962, 964 extending laterally inwardly from the inner surface thereof. The tabs 962, 964 have bores 966, 968. The upper and lower walls have pivot mounting bores 970, 972. The lower bore 972 has an interlocking projection 974 extending inwardly therefrom. The upper wall has a laterally extending bore 976 that opens at an inner end to bore 970 and at its outer end to the exterior of the rudder 960. The manner of connection will be discussed after detailing the piston assembly 952 and its operation.

Referring to FIG. 21, the piston assembly 952 includes a piston rod 978 that moves generally vertically within a piston cylinder 980. A piston head 982 is fixedly mounted to the piston rod 978. Specifically, the piston head 982 has a pair of diametrically opposed bores and the rod 978 has a pair of diametrically opposed bores. A spring pin 984 is inserted through the bores to fix the piston head 982 on the rod 978. A coil spring 986 is received between the upper end of the cylinder 980 and the piston head 982 to bias the piston head downwardly. The lower end of the cylinder 980 is communicated to the pressurized water in venturi 904 by the piston fluid port 955, which is connected to hose 918, which in turn receives pressurized water from the impeller in the tunnel via T-connector 916 and its hose connected to the venturi. Thus, when the water is pressurized by impeller, water flowing into the cylinder 980 forces the piston head 982 upwardly against spring 986. As will be discussed below, because the rudder 960 is pivotally connected to the piston rod 978, it will be raised upwardly into its inoperative position. Holes (not shown) are provided in the upper end of the cylinder 980 to allow water and/or debris that has entered the portion of the cylinder 980 above the piston head 982 to be expelled from the cylinder 980 during its upward movement.

The lower end of the cylinder 980 has a threaded opening that is sealed with a threaded plug 988. A hard plastic wear insert 990 is mounted within the plug's opening to reduce wearing on the plug 988 by the vertical movement of the piston rod 978. A pair of split sealing rings 992, 994 are mounted within the wear insert 990 to provide a seal against the rod 978. The sealing rings 992, 994 are made out of hard plastic to prevent them from wearing down or sticking to the piston rod 978, as may happen if using a soft rubber.

The piston head 982 has an annular groove in which a pair of split sealing rings 996, 998 are received. These sealing rings 996, 998 provide a seal between the piston cylinder interior surface and the piston head 982. One on side of the piston head groove is a projection 1000 that extends downwardly into the vertical split of the upper sealing ring 996. This projection 1000 keeps the upper sealing ring 996 from rotating. A similar projection (not shown) is provided on the other side of the piston head groove and extends upwardly into the vertical split groove of the lower sealing ring 998, which keeps the lower ring 998 from rotating. As a result of these projections, the splits in the rings 996, 998 are prevented from becoming aligned, which functions to provide for a better seal. Similar projections can be provided on wear insert to prevent rings 992, 994 from having their vertical splits aligned.

The interior of the cylinder 980 is tapered, wider at the bottom and narrower at the top. As a result, the seal between the piston head 982 and the piston interior surface is relatively tight to prevent pressure loss. However, as the head 982 travels downwardly, a gap is formed between the piston head 982 and the piston interior surface. This gap enables water underneath the piston head 982 to flow upwardly through the gap to the piston region above the piston head 982, which reduces resistance to the lowering of the piston head 982. This allows for faster movement of the rudder 960 connected to the piston rod 978 down to its operative position.

Referring to FIGS. 21 and 22 together, the upper end of the piston rod 978 has a bore 1004 formed therethrough. The upper end of the piston rod 978 is received in the upper pivot mounting bore 970 of the rudder 960. A threaded rod (not shown is threaded into aperture 976 and inserted into bore 1004 to lock the upper end of the piston rod 978 relative to the rudder 960. The lower end of the piston rod 978 is notched to receive projection 974 therein upon receipt in bore 972. There two connections ensure that the piston rod 978 and the rudder 960 are locked together both rotationally and axially, thus enabling the piston rod 978 and rudder 960 to move together both pivotally and vertically.

Figure 23:
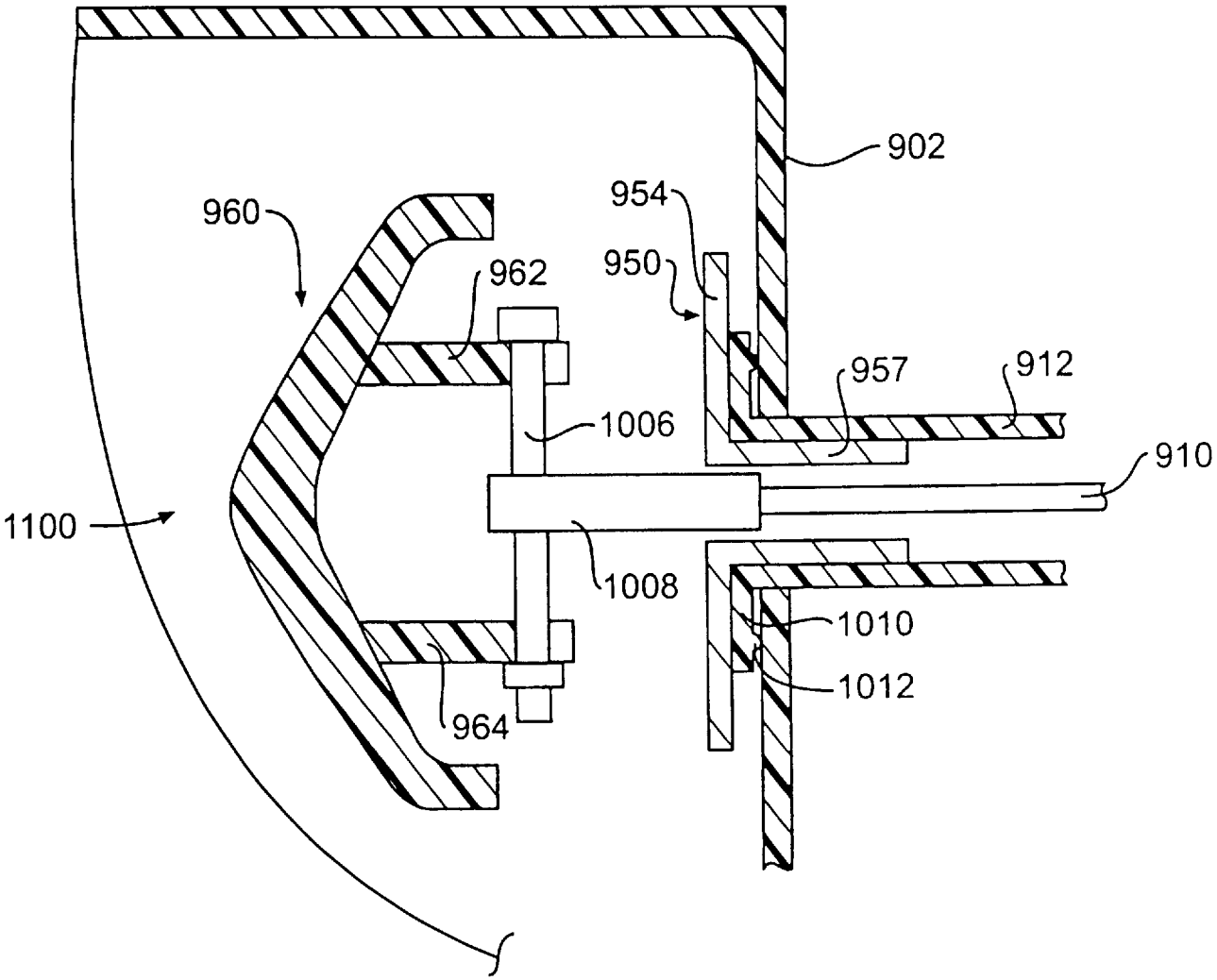
FIG. 23 is a partial cross-sectional view showing the interconnection between the rudder and the rod through the opening in the hull wall in the eighth embodiment.

Referring to FIGS. 22 and 23 together, a bolt 1006 is inserted through the bores 966, 968 of tabs 962, 964. A connector 1008 positioned between the two tabs 962, 964 has a bore in which the bolt 1006 is received. The sleeve 912 has a radially extending flange 1010 that is positioned exteriorly of the hull wall. The flange 1010 has an annular sealing element 1012 that is engaged against the hull wall exterior to inhibit water flow into the hull. The sleeve 912 leads to the tunnel interior, where the presence of water is acceptable. The rod 910 protrudes from the tube 912 and is threadingly engaged within a bore in connector 1008. This establishes a mechanical connection between the rod 910 and the rudder 960 whereby movement of the rod 910 pushes the rudder inwardly and outwardly in a pivoting manner about the piston rod 978. As a result, the lateral movement of the U-shaped member 906 is able to affect corresponding pivotal movement of the rudder 960 through the flexible member 908, the rod 910 and the connector 1008.

The system on the starboard side of the PWC is identical to the one described in this ninth embodiment. Thus, the lateral movement of the U-shaped member 906 is able to affect corresponding pivotal movement of both rudders 960 through the flexible members 908, the rods 910 and the connector 1008.

Figure 24:
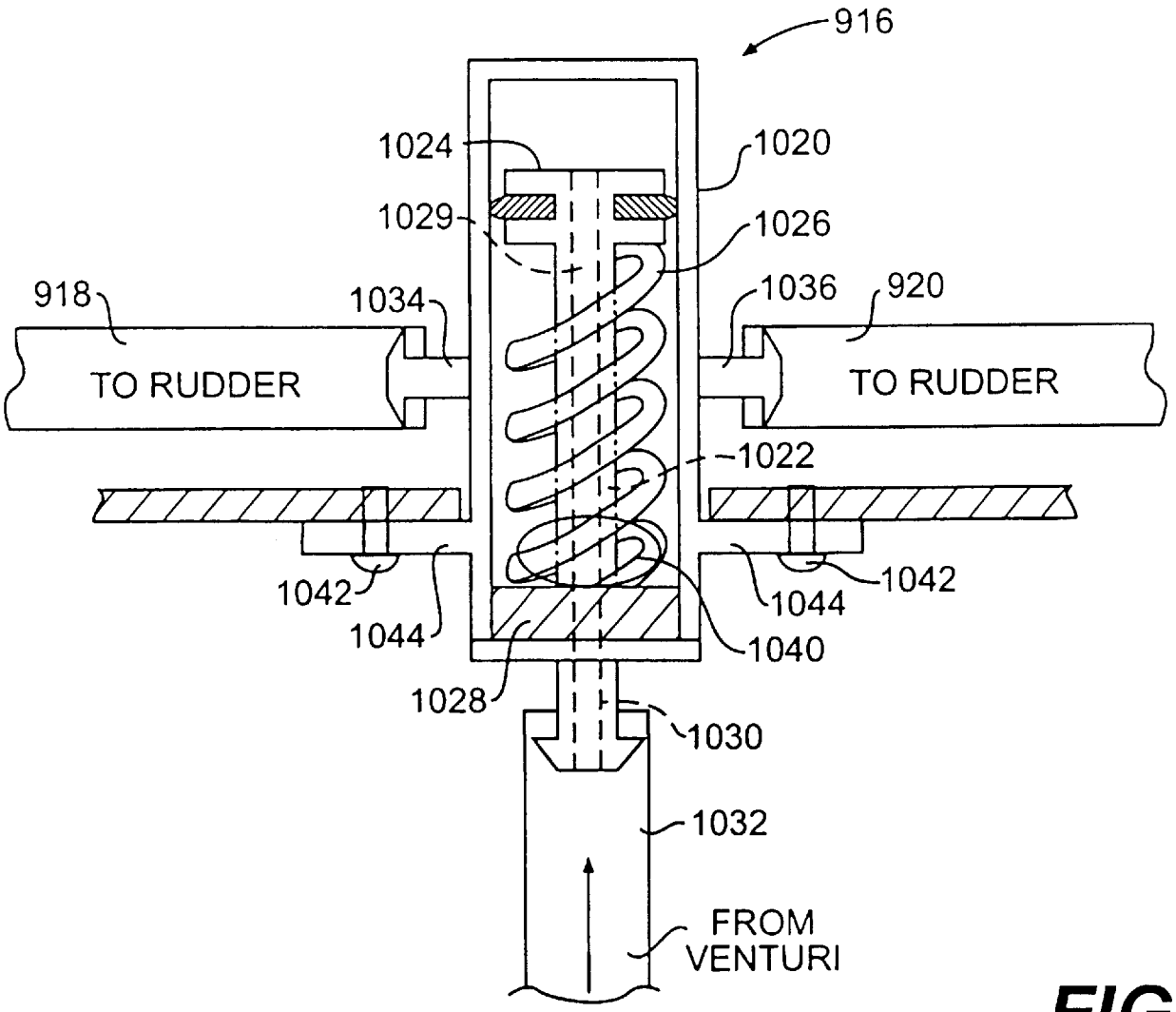
FIG. 24 is a cross-sectional view of a T-connector used in the eighth embodiment of the invention.
Figure 25:
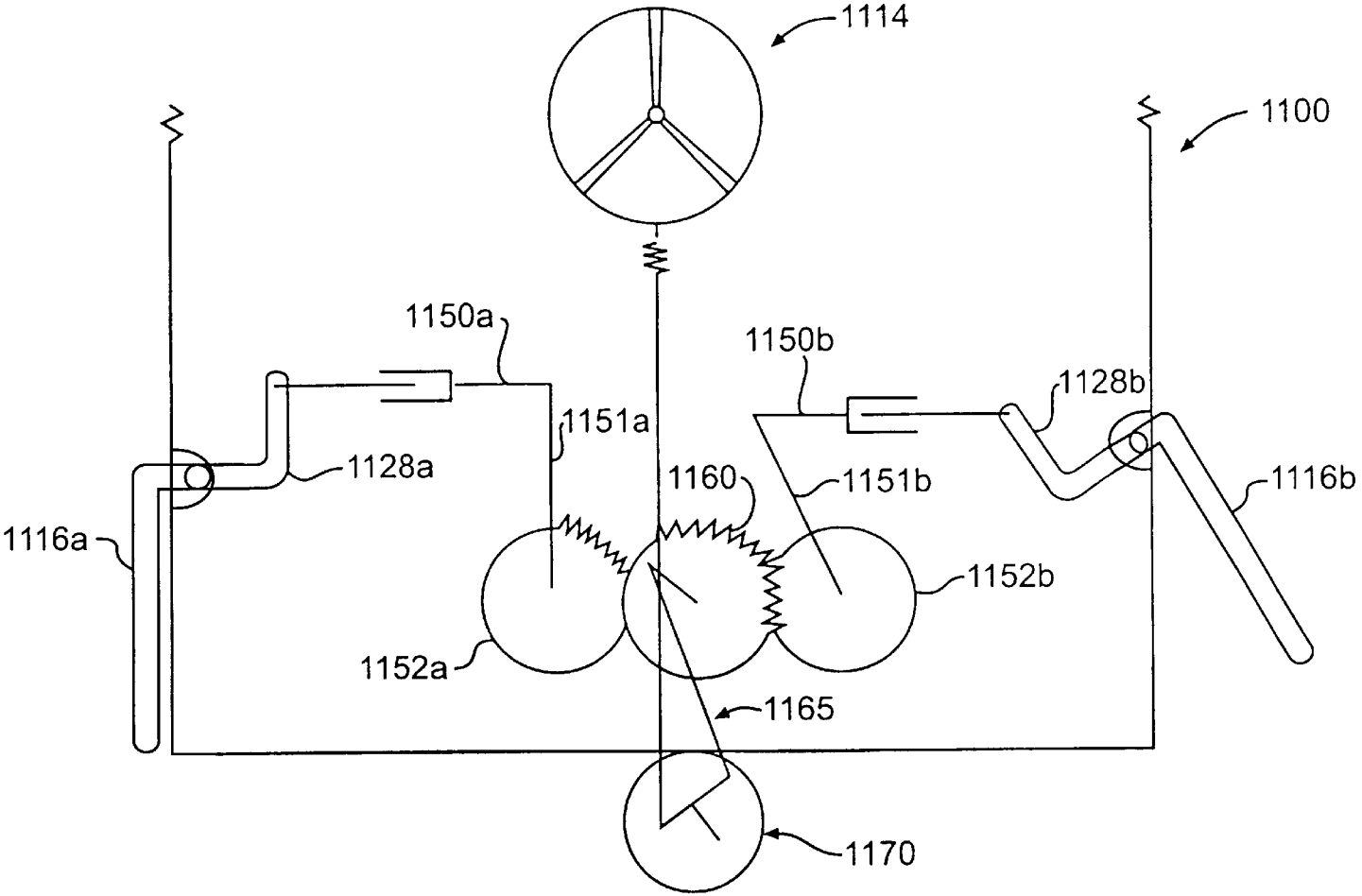
FIG. 25 PRIOR ART
FIG. 25 shows a prior art system using gear operated flaps.

FIG. 24 shows a cross-section of the T-connector 916. The T-connector 916 is designed to function as a valve to let water flowing back from the piston 950 to flow into the tunnel 902 without becoming backed up. The connector 916 includes a cylinder 1020, a tubular piston rod 1022 with an integral piston head 1024 slidably mounted in the cylinder 1020, a spring 1026 biasing the piston head upwardly, and a plug 1028 closing the bottom opening of the cylinder 1020. The piston rod 1022 has a fluid passageway 1029 therethrough.

At the lower end of the piston rod 1022 is a connector 1030 that attaches to a flexible hose 1032 which in turn is connected to the venturi to enable pressurized water from in the venturi to flow upwardly through passageway 1029 and into the upper region of the cylinder 1020. This forces the piston rod 1022 and head 1024 downwardly past connection members 1034 and 1036 so that pressurized water from the venturi flows into these connection members 1034, 1036. The water is then communicated by hoses 918, 920 to their respective piston assemblies 952 to maintain their respective rudders 960 in their inoperative positions. The hose 1032 flexes to accommodate this downward movement. As the water pressure in the venturi drops, the spring 1026 forces the piston head 1024 and rod 1022 upwardly. As the piston head 1024 passes the connectors 1034, 1036, the water in the hoses 918 can flow back into the piston region underneath the piston head 1024 and out through a port 1040 formed in the cylinder 1020. This allows the piston assemblies 952 to responsively push their respective rudders 960 to their operative positions. It should be understood that a standard T-connector could also be used.

The T-connector is connected to the underside of the tunnel wall by bolts 1042 inserted through flanges 1044.

As can be appreciated from viewing FIGS. 18 and 23, the rudders 960 are received within recesses 1100 formed in the stern end of the hull. The recesses extend inwardly from the outboard port and starboard surfaces of the hull and are open rearwardly to the stern and to the bottom of the hull. The rudders 960 are received almost entirely within the recesses 1100 and do not extend substantially outwardly to the port or starboard of the hull. This arrangement prevents the rudders 960 from being damaged during docking or in any other situation wherein the watercraft is maneuvered to have its port or starboard side in close proximity to an object.

From the previous descriptions, a person skilled in the art should understand that it is possible to make a kit to retrofit a watercraft with an off-power steering system. The kit would include at least a linking member, a rudder and a bracket to attach the rudder to the hull. The rudder could be of any type described above, as well as any other type known. With such a kit, the standard nozzle on the watercraft to be retrofitted would require some machining to allow attachment of the linking member to it. Preferably, the kit would include a nozzle adapted for the attachment of the linking element. The kit can also include a clutch mechanism as shown in FIG. 16. The linking member can be of the non-telescopic kind, in which case a flexible member and a U-shaped member, as shown in FIG. 18, could be added to the kit. If the off-power steering system kit is of the type where the rudders can move vertically out of the water, the kit should include a spring. A piston and a water line could also be added to such a kit.

Although the above description contains many specific examples of the present invention, these should not be construed as limiting the scope of the invention but as merely providing illustrations of some of the presently preferred embodiments of this invention.

Additionally, this invention is not limited to PWC. For example, the vertical rudder steering systems disclosed herein may also be useful in small boats or other floatation devices other than those defined as personal watercrafts. The propulsion unit of such craft need not be a jet propulsion system but could be a regular propeller system. In such a case, the water lines between the nozzle and the flaps or rudders could be replaced with lines that provide actuating control to the rudders without using pressurized water. For example, the lines could provide an electrical signal to electrically operate pistons or solenoids. Also, the rudders need not have any connection to the helm or the nozzle. Instead, the rudders could be operated by an actuator separate from the helm. For example, a small joystick could be used to deploy the rudders and determine the direction of steering. Thus, the scope of the invention should be determined by the appended claims and their legal equivalents rather than by the examples given.

What is claimed is:

1. A watercraft, comprising:

a hull having port and starboard sides;

a propulsion system that generates a stream of pressurized water through a nozzle;

at least one rudder positioned on either of the port or starboard sides, the at least one rudder being spaced a predetermined distance away from the respective port or starboard side;

a helm operatively connected to the nozzle such that turning the helm turns the nozzle; and an actuator operatively connected to the at least one rudder.

2. The watercraft of claim 1, wherein the actuator is operatively connected to the helm such that the at least one rudder is operable from the helm.

3. The watercraft of claim 2, wherein the at least one rudder selectively moves between an operative and an inoperative position.

4. The watercraft of claim 3, wherein the at least one rudder has a forward edge and a rearward edge and pivots into the operative position about a point rearward of the forward edge.

5. The watercraft of claim 2, wherein the at least one rudder has an inner surface and an outer surface such that, when the at least one rudder is positioned in the water, water will flow on both the inner and outer surfaces.

6. The watercraft of claim 2, wherein the helm includes a steerable handle bar and the actuator is operatively connected to the handle bar so that turning the handle bar operates the at least one rudder.

7. The watercraft of claim 2, wherein said at least one rudder is positioned at a stern of said hull.

8. The watercraft of claim 2, further comprising a sponson protruding from each side of the hull, wherein the at least one rudder is located behind the sponson.

9. The watercraft of claim 2, wherein the hull forms a recess and the at least one rudder is located in the recess.

10. The watercraft of claim 2, wherein the at least one rudder has a forward edge and a rearward edge and is connected at a pivot point to the hull, wherein the pivot point is spaced rearwardly from the forward edge.

11. The watercraft of claim 10, wherein the at least one rudder selectively pivots inwardly and outwardly about the pivot point.

12. The watercraft of claim 11, wherein the at least one rudder is movable in a substantially vertical direction.

13. The watercraft of claim 12, wherein the actuator further comprises a piston connected between the at least one rudder and the hull for moving the at least one rudder in the substantially vertical direction.

14. The watercraft of claim 13, wherein said piston is mounted within a cylinder carried on a bracket, said bracket being mounted to said hull.

15. The watercraft of claim 14, wherein said cylinder is formed integrally with said bracket as one-piece.

16. The watercraft of claim 13, wherein regulation of fluid pressure within the piston by the actuator causes the at least one rudder to move in the substantially vertical direction.

17. The watercraft of claim 16, wherein the actuator further comprises a water line connected between the propulsion system and the piston to communicate water pressure from the propulsion system to the piston, wherein the propulsion system comprises a venturi, wherein the water pressure in the venturi causes pressurized water to flow in the water line and causes the at least one rudder to move in the substantially vertical direction.

18. The watercraft of claim 17, further comprising:

a spring operatively connected to the at least one rudder to bias the rudder in a downward position, wherein the pressurized water acting on the piston compresses the spring to move the rudder upwardly.

19. The watercraft of claim 17, wherein said at least one rudder includes a port rudder on the port side of said hull and a starboard rudder on the starboard side of said hull;

the aforesaid piston being a port piston connected between the port rudder and the hull and said actuator further comprising a starboard piston connected between the starboard rudder and the hull for moving the starboard rudder in the substantially vertical direction;

said actuator further comprising a T-connector connected to said venturi, the aforesaid water line being a port water line connected between said port piston and said T-connector and said actuator further comprising a starboard water line connected between said starboard piston and said T-connector.

20. The watercraft of claim 19, further comprising a check valve movable between open and closed position responsive to water pressure in said venturi to control the flow of water to said pistons through said water lines.

21. The watercraft of claim 20, wherein said pistons are configured such that water flowing from said venturi to said pistons via said water lines raises said rudders to raised positions, said check valve being movable from said closed position thereof to said open position thereof responsive to water pressure in the venturi exceeding a predetermined threshold.

22. The watercraft of claim 19, wherein the predetermined distance is about 1.5 inches.

23. The watercraft of claim 12, further comprising:

a spring operatively connected to the at least one rudder to bias the rudder in a downward position.

24. The watercraft of claim 12, further comprising:

a spring operatively connected to the at least one rudder to bias the rudder in an upward position.

25. The watercraft of claim 12, wherein the at least one rudder has a lower leading edge that curves upwardly.

26. The watercraft of claim 12, wherein a lower trailing edge of the at least one rudder curves upwardly so that the flow of water over the at least one rudder is accelerated to create a low-pressure region that assists in moving the at least one rudder downwardly.

27. The watercraft of claim 12, further comprising a mini flap connected to the at least one rudder, wherein the mini flap is selectively rotatable to a predetermined angle with respect to an inner and outer surfaces of the at least one rudder to bias the at least one rudder downwardly when water flows thereacross.

28. The watercraft of claim 2, wherein the actuator is a linking element that operatively connects the at least one rudder to the nozzle.

29. The watercraft of claim 28, wherein the linking element is non-telescopic.

30. The watercraft of claim 29, further comprising a flexible member between the linking element and the nozzle.

31. The watercraft of claim 28, wherein the linking element extends inside the hull.

32. The watercraft of claim 31, further comprising a tube located inside the hull, wherein the tube surrounds the linking element to prevent water from entering the hull.

33. The watercraft of claim 28, wherein the linking element is positioned rearwardly of the hull.

34. The watercraft of claim 2, wherein the at least one rudder comprises first and second rudders.

35. The watercraft of claim 34, wherein the first and second rudders are angled inwardly toward the hull such that drag is increased when said rudders are in the water.

36. The watercraft of claim 2, wherein the actuator includes a first linking element that operatively connects the first rudder to the nozzle and a second linking element that operatively connects the second rudder to the nozzle.

37. The watercraft of claim 36, further comprising a U-shaped member connected to the nozzle, wherein the U-shaped member has a first arm and a second arm, and wherein the first linking element is connected to the first arm and the second linking element is connected to the second arm.

38. The watercraft of claim 37, further comprising a first flexible member and a second flexible member, wherein the first flexible member is connected between the first linking element and the first arm, and the second flexible member is connected between the second linking element and the second arm.

39. The watercraft of claim 36, wherein the actuator causes the first and second rudders have different turning angles.

40. The watercraft of claim 2, wherein the predetermined distance that the at least one rudder is spaced from the hull is between about 0.5 and 2 inches.

41. The watercraft of claim 2, wherein the at least one rudder has at least one fin.

42. The watercraft of claim 41, wherein the at least one rudder defines a plurality of openings that permit water to flow through the at least one rudder, the openings being separated from one another by the at least one fin.

43. The watercraft of claim 41, wherein the at least one fin is angled to bias the at least one rudder downwardly when water flows thereacross.

44. The watercraft of claim 43, wherein the at least one fin is angled between 5 and 25 degrees from horizontal.

45. The watercraft of claim 44, wherein the at least one fin is angled at 15 degrees from horizontal.

46. The watercraft of claim 41, wherein the at least one rudder has a forward edge with a raised nose, wherein the raised nose redirects water flowing over the rudder to prevent water from engaging the at least one fin when the at least one rudder is in an inoperative position.

47. The watercraft of claim 2, wherein the at least one rudder has an airfoil shaped horizontal cross-section.

48. The watercraft of claim 2, wherein the at least one rudder has a forward edge and a rearward edge and is bent into at least two segments between the forward and rearward edges.

49. The watercraft of claim 2, further comprising a motor coupled to the propulsion system and a clutch mounted to the propulsion system, wherein a portion of the clutch is in contact with water flowing through the propulsion system.

50. The watercraft of claim 49, wherein the clutch is operated by a predetermined water pressure in the propulsion system.

51. The watercraft of claim 50, wherein the clutch operatively connects the at least one rudder to the nozzle when water pressure is below the predetermined water pressure.

52. The watercraft of claim 51, wherein the predetermined water pressure is less than a water pressure that corresponds to a speed of the motor of about 2500 RPM.

53. The watercraft of claim 52, wherein the predetermined water pressure is between a water pressure that corresponds to a speed of the motor of about 3500–5500 RPM.

54. The watercraft of claim 53, wherein the predetermined water pressure is a water pressure that corresponds to a speed of the motor of about 4500 RPM.

55. A watercraft, comprising:

a hull having port and starboard sides;

a propulsion system that generates a stream of pressurized water through a nozzle;

a helm operatively connected to the nozzle such that turning the helm turns the nozzle; and at least one flap connected to either the port or starboard side for pivotal movement about first and second non-parallel pivot axes, said at least one flap being arranged such that (a) pivotal movement of said flap about said first pivot axis pivots said flap outwardly from said hull to control steering of the watercraft and (b) pivotal movement of said flap about said second pivot axis moves said flap upwardly and downwardly to vary a depth at which said flap is positioned in water, wherein said at least one flap is operatively connected to the helm such that the at least one flap can be move about the first and second pivot axis via operation of the helm.

56. The watercraft of claim 55, wherein the first pivot axis is substantially horizontal, and the second pivot axis is substantially vertical.

57. The watercraft of claim 56, wherein the at least one flap is operatively connected to the nozzle.

58. The watercraft of claim 57, further comprising:

a telescopic linking member connecting the at least one flap to the nozzle.

59. The watercraft of claim 58, such that turning the helm pivots the at least one flap about said first axis in the flow of water to turn the watercraft.

60. The watercraft of claim 58, further comprising:

a ball joint rod connecting the flap to the hull.

61. The watercraft of claim 56, wherein the at least one flap comprises a hinge.

62. The watercraft of claim 61, wherein the hinge defines the second pivot axis.

63. The watercraft of claim 56, wherein the at least one flap comprises a first and second flap.

64. The watercraft of claim 63, wherein turning the helm moves only one of the first and second flaps in an operative position.

65. A rudder, comprising:

a main body having a forward edge, a rearward edge, a first side, and a second side, said main body further having a pivotal mounting structure constructed to enable said rudder to be pivotally connected to a watercraft; and at least one tin projecting outwardly from at least one of the first and second sides, wherein said main body has a raised nose at the forward edge, the raised nose being configured to direct water flowing over the rudder away from the at least one fin when said main body is oriented in the direction of the water flow.

66. A rudder, comprising:

a main body having a forward edge, a rearward edge, a first side, and a second side, said main body further having a pivotal mounting structure constructed to enable said rudder to be pivotally connected to a watercraft; and at least one fin projecting outwardly from at least one of the first and second sides, wherein the rudder defines a plurality of openings therethrough, said openings being separated from one another by the at least one fin.

67. The rudder of claim 65, wherein the at least one fin is oriented such that, when said pivotal mounting structure is pivotally connected to the watercraft, said at least one fin extends at a downward and forward angle from said main body.

68. The rudder of claim 67, wherein said angle is between 5 and 25 degrees from horizontal.

69. The rudder of claim 68, wherein said angle is 15 degrees from horizontal.

70. The rudder of claim 65, wherein said main body further includes a lower leading edge that curves upwardly.

71. The rudder of claim 65, further comprising a lower trailing edge that curves upwardly.

72. The rudder of claim 65, wherein said pivotal mounting structure is spaced rearwardly of the forward edge.

73. A rudder, comprising:

a main body having a forward edge, a rearward edge, a first side, and a second side, said main body further having a pivotal mounting structure constructed to enable said rudder to be pivotally connected to a watercraft; and at least one fin projecting outwardly from at least one of the first and second sides, wherein said main body has an airfoil-shaped horizontal cross-section.

74. A rudder, comprising:

a main body having a forward edge, a rearward edge, a first side, and a second side, said main body further having a pivotal mounting structure constructed to enable said rudder to be pivotally connected to a watercraft; and at least one fin projecting outwardly from at least one of the first and second sides, wherein said main body is bent into at least two segments between its forward and rearward edges.

75. A rudder, comprising:

a main body having a forward edge, a rearward edge, a first side, and a second side, said main body further having a pivotal mounting structure constructed to enable said rudder to be pivotally connected to a watercraft; and a mini-flap rotatably mounted to said main body to enable an angle of said mini-flap to be adjusted with respect to said main body.

76. The rudder of claim 75, wherein a rotation axis of the mini-flap extends at a non-perpendicular angle with respect to a pivot axis defined by said pivotal mounting structure.

77. The rudder of claim 76, wherein the rotation axis is angled between 5 and 25 degrees from perpendicular with respect to said pivot axis.

78. The rudder of claim 77, wherein the rotation axis is angled at 15 degrees from perpendicular with respect to said pivot axis.

79. The rudder of claim 75, wherein said main body has a lower leading edge that curves upwardly.

80. The rudder of claim 75, wherein said main body has a lower trailing edge and the lower trailing edge curves upwardly.

81. The rudder of claim 75, wherein said pivotal mounting structure is spaced rearwardly of the forward edge.

82. A method of controlling a watercraft, comprising:

operating an actuator;

in response to operating the actuator, turning at least one rudder positioned a predetermined distance away from a port or starboard side of a hull of the watercraft; and directing a flow of water adjacent to the watercraft with the at least one rudder such that water flows between an inside surface of the respective rudder and the side of the hull and also flows over an outer surface of the rudder to affect steering of said watercraft.

83. The method of claim 82, wherein the actuator is operatively connected to a helm of the watercraft such that operating said actuator can be affected via said helm.

84. The method of claim 83, wherein a nozzle is operatively connected to the helm wherein actuating the helm turns the nozzle and the nozzle turns the at least one rudder.

85. The method of claim 82, wherein the at least one rudder comprises a first rudder on the starboard side of said hull and a second rudder on a port side of said hull.

86. The method of claim 85, wherein the first and second rudders are angled inwardly toward the hull such that drag is increased when said rudders are in the water.

87. The method of claim 86, wherein said actuator responsively turns the first rudder inwardly, and the second rudder outwardly.

88. The method of claim 82, further comprising lowering the rudder in water.

89. The method of claim 88, wherein the rudder comprises at least one fin angled such that water flowing over the fin lowers the rudder.

90. The method of claim 88, further comprising rotating a mini-flap of the rudder while turning the rudder such that water flowing against the mini-flap lowers the rudder.

91. The method of claim 88, further comprising raising the rudder out of water.

92. The method of claim 91, wherein water pressure from a propulsion system raises the rudder.

93. The method of claim 92, further comprising a spring biasing the rudder downwardly.

94. The method of claim 82, further comprising:

lowering the rudder from a raised position into a lowered position in the water in response to water pressure in a propulsion system of the watercraft being below a predetermined level; and raising the rudder from said lowered position out of the water to said raised position in response to the water pressure in a propulsion system of the watercraft being above the predetermined level.

95. The method of claim 82, wherein said actuator comprises a clutch for operatively connecting said at least one rudder to said helm to enable turning of said helm to turn said rudder and wherein said method further comprises engaging said clutch to operatively connect said at least one rudder with said helm.

96. The method of claim 95, wherein the clutch is engaged in response to water pressure in a propulsion system of said watercraft being below a predetermined level.

97. The method of claim 96, further comprising disengaging the clutch to disconnect said at least one rudder from said helm in response to the water pressure in the propulsion system being above the predetermined level.

98. The method of claim 97, wherein the predetermined level is a water pressure corresponding to a motor speed of about 2500 RPM.

99. The method of claim 97, wherein the predetermined level is a water pressure corresponding to a motor speed between 3500 and 5500 RPM.

100. The method of claim 99, wherein the predetermined level is a water pressure corresponding to a motor speed of about 4500 RPM.

101. A kit for retrofitting a watercraft having a propulsion system that generates a stream of pressurized water through a nozzle and a helm operatively connected to the nozzle such that turning the helm turns the nozzle, said kit comprising:

a rudder;

a bracket constructed to be mounted to a port or starboard side of the hull, said bracket being further constructed to support said rudder in spaced relation away from the respective port or starboard side of the hull; and an actuator constructed and arranged to operatively connect the rudder to the helm so that the rudder is operable from the helm.

102. The kit of claim 101, wherein said actuator is a linking member constructed to be connected between the nozzle and the rudder.

103. The kit of claim 102, further comprising a tube to place around the linking member.

104. The kit of claim 102, further comprising a clutch constructed to selectively connect the nozzle to the rudder.

105. The kit of claim 101, wherein said rudder pivotally mounts to said bracket.

106. The kit of claim 101, wherein said rudder pivotally mounts to said bracket in spaced relation from a forward edge of said rudder.

107. The kit of claim 101, wherein the rudder comprises a mini-flap rotatably mounted thereto to enable an angle of said mini-flap to be adjusted.

108. The kit of claim 101, wherein the rudder comprises at least one fin projecting outwardly therefrom.

109. The kit of claim 101, wherein the actuator further comprises a piston connected to the at least one rudder, said piston being constructed and arranged to raise and lower the rudder.

110. The kit of claim 109, wherein said piston is mounted with a cylinder carried on said bracket.

111. The kit of claim 110, wherein said cylinder is formed integrally with said bracket as one-piece.

112. The kit of claim 109, wherein the actuator further comprises:

a water line adapted for connection between said piston and a venturi of the watercraft propulsion system so as to enable water pressure in the venturi to flow in the waterline to raise or lower the piston.

113. The kit of claim 112, wherein said rudder and said bracket are a port rudder and a port bracket, respectively, and wherein the watercraft further comprises a starboard rudder and a starboard bracket;

the aforesaid piston being a port piston adapted to be connected between the port rudder and the port side of the hull and said actuator further comprising a starboard piston adapted to be connected between the starboard rudder and the starboard side of the hull for moving the starboard rudder in the substantially vertical direction;

said actuator further comprising a T-connector adapted to be connected to said venturi, the aforesaid water line being a port water line adapted to be connected between said port piston and said T-connector, said actuator further comprising a starboard water line adapted to be connected between said starboard piston and said T-connector.

114. The kit of claim 113, wherein said T-connector comprises a check valve movable between open and closed positions responsive to water pressure in said venturi to control the flow of water to said pistons through said water lines.

115. The kit of claim 114, wherein said pistons are configured such that water flowing from said venturi to said piston via said water lines raises said rudders to raised positions, said check valve being movable from said closed position thereof to said open position thereof responsive to water pressure in the venturi exceeding a predetermined threshold.

116. The kit of claim 101, wherein the actuator further comprises a U-shaped member constructed to be operatively connected between the nozzle and said rudder.

117. The kit of claim 101, wherein the actuator further comprises spring for biasing the at least one rudder downwardly.

118. The kit of claim 117, wherein the actuator further comprises a piston connected to the rudder for raising the piston against the biasing of said spring.

119. The kit of claim 118, wherein the actuator further comprises a water line adapted for connection between said piston and a venturi of the watercraft propulsion system so as to enable water pressure in the venturi to flow in the water line to raise the piston.

120. The kit of claim 101, wherein the actuator further comprises a flexible member connectable between the nozzle and the at least one rudder to prevent impact forces applied to the rudder from being transmitted to the nozzle.

121. A kit for retrofitting a watercraft having a propulsion system that generates a stream of pressurized water and a helm, said kit comprising:

a nozzle constructed and arranged to be positioned adjacent the propulsion system and operatively connected to the helm such that said nozzle directs the stream of pressurized water and turning the helm turns the nozzle;

a rudder;

a bracket constructed to be mounted to a port or starboard side of the hull, said bracket being further constructed to support said rudder in spaced relation away from the respective port or starboard side of the hull; and a linking element constructed and arranged to operatively connect the rudder to the nozzle so that turning of the nozzle via said helm can affect movement of the rudder.

122. The kit of claim of 121, further comprising a tube adapted to be placed around the linking member.

123. The kit of claim 121, further comprising a clutch constructed to selectively connect the nozzle to the rudder.

124. The kit of claim 123, wherein the rudder pivotally mounts to said bracket in spaced relation from a forward edge of said rudder.

125. The kit of claim 121, wherein the rudder comprises a mini-flap rotatably mounted thereto to enable an angle of said mini-flap to be adjusted.

126. The kit of claim 121, wherein the rudder comprises at least one fin projecting outwardly therefrom.

127. The kit of claim 121, wherein said actuator further comprises a piston connected to the rudder, said piston being constructed and arranged to raise and lower the rudder.

128. The kit of claim 127, wherein said piston is mounted with a cylinder carried on said bracket.

129. The kit of claim 128, wherein said cylinder is formed integrally with said bracket as one-piece.

130. The kit of claim 127, wherein the actuator further comprises a water line connectable between said piston and a venturi of the watercraft propulsion system so as to enable water pressure in the venturi to flow in the water line to raise or lower the piston.

131. The kit of claim 130, wherein said rudder and said bracket are a port rudder and a port bracket, respectively, and wherein the watercraft further comprises a starboard rudder and a starboard bracket;

the aforesaid piston being a port piston adapted to be connected between the port rudder and the port side of the hull and said actuator further comprising a starboard piston adapted to be connected between the starboard rudder and the starboard side of the hull for moving the starboard rudder in the substantially vertical direction;

said actuator further comprising a T-connector adapted to be connected to said venturi, the aforesaid water line being a port water line adapted to be connected between said port piston and said T-connector, said actuator further comprising a starboard water line adapted to be connected between said starboard piston and said T-connector.

132. The kit of claim 131, wherein said T-connector comprises a check valve movable between open and closed positions responsive to water pressure in said venturi to control the flow of water to said piston through said water lines.

133. The kit of claim 132, wherein said pistons are configured such that water flowing from said venturi to said piston via said water lines raises said rudders to raised positions, said check valve being movable from said closed position thereof to said open position thereof responsive to water pressure in the venturi exceeding a predetermined threshold.

134. The kit of claim 130, wherein the actuator further comprises a U-shaped member constructed to be operatively connected between the nozzle and the rudder.

135. The kit of claim 121, wherein the actuator further comprises a spring for biasing the at least one rudder downwardly.

136. The kit of claim 135, wherein the actuator further comprises a piston connected to the rudder for raising the piston against the biasing of said spring.

137. The kit of claim 136, wherein the actuator further comprises a water line adapted for connection between said piston and a venturi of the watercraft propulsion system so as to enable water pressure in the venturi to flow in the water line to raise the piston.

138. The kit of claim 121, wherein the actuator further comprises a flexible member connectable between the nozzle and the at least one rudder to prevent impact forces applied to the rudder from being transmitted to the nozzle.

139. A watercraft hull comprising:

port and starboard sides;

a stern adapted to receive a propulsion system that generates a stream of pressurized water through a nozzle;

a starboard rudder receiving recess on said starboard side of said hull proximate a stern end thereof, said starboard rudder receiving recess being configured to receive a starboard rudder therein such that said starboard rudder does not protrude laterally from said starboard side of said hull; and a port rudder receiving recess on said port side of said hull proximate a stern end thereof, said port rudder receiving recess being configured to receive a port rudder therein such that said port rudder does not protrude laterally from said port side of said hull.

140. An off-power steering system for a watercraft comprising a hull having port and starboard sides; a propulsion system that generates a stream of pressurized water through a nozzle; and a helm operatively connected to the nozzle such that turning the helm turns the nozzle; the steering system comprising:

at least one rudder positioned on either of the port or starboard sides, the at least one rudder being spaced a predetermined distance away from the respective port or starboard side; and an actuator operatively connected to the at least one rudder.

141. A jet propulsion device comprising:

a nozzle through which pressurized fluid flows;

a pressure responsive actuating member operatively connected to the nozzle that reacts to pressurized fluid flow at a threshold pressure; and an element coupled to the pressure responsive actuating member that responds when the fluid in the nozzle achieves the threshold pressure.

142. The jet propulsion device of claim 141 in combination with a watercraft.

143. The jet propulsion device of claim 141 wherein the nozzle receives water as the pressurized fluid.

144. The jet propulsion device of claim 141, wherein the pressure responsive actuating member comprises at least one water passage from the nozzle and a piston coupled to the water passage.

145. The jet propulsion device of claim 141, wherein the pressure responsive actuating member comprises a spring biased nozzle rudder that selectively protrudes into the fluid flow.

146. The jet propulsion device of claim 141, wherein the element coupled to the pressure responsive actuating member comprises at least one rudder.

147. The jet propulsion device of claim 141, wherein the element coupled to the pressure responsive actuating member comprises at least one flap.

148. The jet propulsion device of claim 141, wherein the element coupled to the pressure responsive actuating member comprises a trim system.

149. The jet propulsion device of claim 141, wherein the element responds with a mechanical movement.

150. The jet propulsion device of claim 141, wherein the element responds with an electrical signal.

151. The jet propulsion device of claim 141, wherein the element is a steering control mechanism.

152. The jet propulsion device of claim 151, wherein the pressure responsive actuating member reacts at the threshold pressure to disengage the steering control mechanism.

153. A jet propelled watercraft comprising:

a hull;

a nozzle coupled to the hull through which pressurized water flows to drive the watercraft;

a pressure responsive actuating member operatively connected to the nozzle that reacts to pressurized water flow at a threshold pressure; and an element supported by the hull and coupled to the pressure responsive actuating member that responds when the water in the nozzle achieves the threshold pressure.

154. The jet propelled watercraft of claim 153, wherein the pressure responsive actuating member comprises a water passage in communication with the nozzle and a piston coupled to the water passage, wherein the piston causes the element to provide steering control when water pressure in the nozzle is equal to or less than the threshold pressure.

155. The jet propelled watercraft of claim 153, wherein the pressure responsive actuating member comprises a spring biased rudder disposed in the nozzle, wherein the rudder causes the element to disengage when water pressure in the nozzle is equal to or greater than the threshold pressure.

* * * * *